US009676111B2

(12) United States Patent
Hahn

(10) Patent No.: US 9,676,111 B2
(45) Date of Patent: Jun. 13, 2017

(54) RAZOR AND RAZOR TREATMENT SYSTEM

(71) Applicant: Leaf Shave Company LLC, Pittsburgh, PA (US)

(72) Inventor: Adam J. Hahn, Pittsburgh, PA (US)

(73) Assignee: Leaf Shave Company LLC, Pittsburgh, PA (US)

( * ) Notice: Subject to any disclaimer, the term of this patent is extended or adjusted under 35 U.S.C. 154(b) by 131 days.

(21) Appl. No.: 14/149,236

(22) Filed: Jan. 7, 2014

(65) Prior Publication Data

US 2014/0190014 A1 Jul. 10, 2014

Related U.S. Application Data

(60) Provisional application No. 61/750,079, filed on Jan. 8, 2013.

(51) Int. Cl.
*B26B 21/50* (2006.01)
*B26B 21/40* (2006.01)

(52) U.S. Cl.
CPC ..... *B26B 21/50* (2013.01); *B26B 21/40* (2013.01); *B26B 21/4012* (2013.01); *B26B 21/4037* (2013.01); *B26B 21/4062* (2013.01)

(58) Field of Classification Search
CPC ..... B26B 21/50; B26B 21/38; B26B 21/521; B24B 3/48
USPC ..... 451/191, 205, 316, 234; 30/10, 38, 35, 30/37, 77
See application file for complete search history.

(56) References Cited

U.S. PATENT DOCUMENTS

| | | | | |
|---|---|---|---|---|
| 1,060,657 | A | | 5/1913 | Alter |
| 1,159,487 | A | | 11/1915 | Fuller |
| 1,205,187 | A | | 11/1916 | Fuller |
| 1,206,315 | A | | 11/1916 | Ehrlich |
| 1,220,837 | A | | 3/1917 | Fuller |
| 1,367,158 | A | | 2/1921 | McAuliffe |
| 1,411,287 | A | | 4/1922 | McAuliffe |
| 1,482,371 | A | | 1/1924 | Witter |
| 1,492,246 | A | * | 4/1924 | Gaisman ..... B26B 21/16 30/38 |
| 1,497,030 | A | | 6/1924 | Salerni |
| 1,522,716 | A | | 1/1925 | Frank |
| 1,550,861 | A | | 8/1925 | Wolcott |
| 1,552,234 | A | | 9/1925 | Roebuck |
| 1,581,469 | A | | 4/1926 | Oskin |
| 1,635,827 | A | | 7/1927 | Frank |
| 1,710,548 | A | | 4/1929 | Minahan |

(Continued)

*Primary Examiner* — Larry E Waggle, Jr.
*Assistant Examiner* — Lauren Beronja
(74) *Attorney, Agent, or Firm* — The Webb Law Firm

(57) ABSTRACT

A razor treatment system includes a razor having a head, and a razor treatment device including a drum rotationally supported within the razor treatment device, at least two cam members supported within the razor treatment device, at least two guide members configured to cooperate with the cam members to expose the blade, and a first actuating member configured to effect rotation of the drum. The head includes a cover for housing a blade. The cover is configured to expose the blade. The razor interfaces with the razor treatment device to move the cover of the razor to expose the blade. Each cam member may define a cam track that guides linear retraction of the blade, rotational movement of the blade and cover, and linear extension of the blade into a position between the drums.

26 Claims, 22 Drawing Sheets

(56) References Cited

U.S. PATENT DOCUMENTS 1,719,675 A 7/1929 Sirch
1,734,524 A 11/1929 Kohlmiller
1,735,751 A * 11/1929 Green ..... B26B 21/00 30/47
1,744,752 A * 1/1930 Crespo ..... 451/202
1,805,895 A 5/1931 Watson
1,826,410 A 10/1931 Aronson
1,853,839 A 4/1932 Wolcott
1,859,555 A 5/1932 De Haven
1,871,789 A 8/1932 Green
1,887,911 A 11/1932 Aronson
1,901,591 A * 3/1933 Godshalk ..... 30/58
1,905,331 A 4/1933 Aronson
1,907,783 A * 5/1933 Gaisman ..... B26B 21/30 30/346.58
1,914,630 A 6/1933 Aronson
1,920,711 A 8/1933 Pelizzola
1,929,463 A 10/1933 Wolcott
1,932,386 A 10/1933 Aronson
1,952,253 A * 3/1934 Hoff ..... 30/35
1,954,259 A 4/1934 Norviel
1,959,841 A 5/1934 Sage
1,965,348 A 7/1934 Lucia
1,966,425 A 7/1934 Aronson
1,966,426 A 7/1934 Aronson
1,978,988 A 10/1934 Cook et al.
2,001,155 A 5/1935 Peters
2,026,125 A * 12/1935 Godshalk et al. ..... 451/192
2,048,868 A 7/1936 Johnston
2,090,968 A * 8/1937 Testi ..... B26B 21/30 30/58
2,113,772 A * 4/1938 Steinmetz ..... B26B 21/24 30/346.55
2,125,135 A 7/1938 Trippe
2,252,499 A 8/1941 Flaws, Jr.
2,252,569 A 8/1941 Kennison
2,290,964 A * 7/1942 Hill ..... 451/191
2,319,488 A 5/1943 Burchett
2,397,555 A 4/1946 Lotthamer
2,429,334 A 10/1947 Smith
2,458,257 A 1/1949 Donovan
2,565,281 A 8/1951 Thomas
2,581,214 A 1/1952 Stegner
2,602,220 A 7/1952 Ewing
2,602,221 A 7/1952 Ewing et al.
2,640,258 A 6/1953 Eckert
2,666,982 A * 1/1954 Schroder ..... B26B 21/08 30/31
2,769,232 A * 11/1956 Leonard, Sr. ..... B26B 21/32 30/41.8
2,780,866 A * 2/1957 Borden ..... 30/60.5
2,787,921 A 4/1957 Blankenship
2,839,829 A 6/1958 Knapp
2,911,712 A 11/1959 Choclin et al.
3,057,062 A 10/1962 Mashiba
3,080,651 A * 3/1963 La Cas ..... B26B 21/16 30/527
3,101,536 A 8/1963 Bringewald
3,167,888 A 2/1965 Shanley
3,199,252 A 8/1965 Hanchey
3,653,123 A * 4/1972 King et al. ..... 30/58
3,909,942 A * 10/1975 Ciaffone ..... B26B 21/4062 30/47
4,265,055 A 5/1981 Cartwright et al.
4,345,374 A 8/1982 Jacobson
4,485,554 A 12/1984 Bergamaschi
4,608,782 A 9/1986 Chylinski
4,807,401 A 2/1989 Atwater
4,860,449 A 8/1989 Duncan
5,036,731 A 8/1991 Fletcher
5,074,042 A * 12/1991 Althaus ..... B26B 21/227 30/50
5,139,138 A 8/1992 Isaksen
5,253,420 A * 10/1993 Althaus ..... B26B 21/227 30/47
6,449,849 B1 9/2002 Hackerman
6,694,618 B1 2/2004 de Villiers
7,104,874 B1 * 9/2006 Gussack et al. ..... 451/234
8,074,535 B2 12/2011 Martell
2009/0000426 A1 1/2009 Andersen et al.
2010/0139103 A1 6/2010 Miyazaki
2010/0223792 A1 9/2010 Martell
2012/0317820 A1 * 12/2012 McGushion ..... B26B 29/02 30/164
2013/0237134 A1 9/2013 Worthington

* cited by examiner

RAZOR AND RAZOR TREATMENT SYSTEM

CROSS REFERENCE TO RELATED APPLICATIONS

This application claims the benefit of U.S. Provisional Application No. 61/750,079, filed Jan. 8, 2013, the disclosure of which is hereby incorporated in its entirety by reference.

BACKGROUND OF THE INVENTION

Field of the Invention

This disclosure relates generally to razor treatment systems and, more particularly, to a razor configured to interact with a razor treatment system.

Description of Related Art

Razors have become ubiquitous and are used by both men and women for their personal shaving needs. Straight-blade razors, which are made of high carbon or stainless steel, exemplify the early modern popular style of shaving implements. These razors can be used for many shaving sessions over a long period of time, but must be maintained by regular sharpening and stropping. The process of sharpening, or honing, the blade uses an abrasive material that removes material from the blade's edge. Stropping, which must be done with each use of a straight-blade razor, straightens and re-aligns the blade, which tends to bend and pit under use, preventing a close shave if not straightened.

Double-edged safety razors replaced the straight edge in popularity in the early part of the twentieth century. The disposal of blades after limited use was made popular and economical by the arrival of blades made of low-cost, thin steel, thereby eliminating the need for stropping or honing. The safety feature of these razors, protecting the user from all but the very edge of the blade, appealed to users. The orientation of the handle and the blade required the user to develop the proper technique to achieve an optimal shave. The next evolution combined the safety of small, thin blades exposed only at the edge, with the proper angle-of-attack and a pivoting head to adjust to the contours of the face. The disposable razor embodied the ease and simplicity of shaving, sacrificing longevity of product by providing disposable blades with limited life. This incarnation of men's and women's personal shaver remains the most popular and widely used, contributing a sizeable negative global economic impact.

While the convenience and ease of use of current disposable razor technology is attractive to users, improvements to certain aspects of the technology may be desirable. A razor that incorporates the safety and usability aspects of the safety razor and the longevity of the straight blade razor would be a desirable improvement to razor technology.

Several different razor sharpening systems are known in the art, however, many of these sharpening systems fail to provide simplified sharpening and stropping of a razor. The razor blade disclosed in U.S. Pat. No. 1,805,895 is used in a stropping device to bend the blade of the razor. However, the razor head remains stationary within the stropping device and fails to work in concert with the stropping device to expose the blade for stropping. Likewise, the razor sharpening system disclosed in U.S. Patent Application Publication No. 2013/0237134 fails to provide a razor with a head that works in concert with the sharpening system. This sharpening system does not use drums with an abrasive material to sharpen the blade nor is the blade sharpened by rotational movement of the drums. Further, the razor does not open and extend into the sharpening device through the use of a cam track to expose the blade of the razor. Similarly, U.S. Pat. No. 7,104,874 discloses a razor sharpening system. However, this sharpening apparatus does not use drums with an abrasive material directly attached on an outer diameter of the drums nor does the razor open and extend the razor blades upon insertion into the sharpening apparatus. This sharpening apparatus is directed towards prolonging the use of a disposable razor, rather than a razor that is specifically designed to operate in concert with the sharpening device. The sharpening apparatus is used to resharpen existing cartridge razors but does not expose the underside of the razor blade.

SUMMARY OF THE INVENTION

In one embodiment, a razor treatment system is provided. The razor treatment system generally comprises a razor having a head and a razor treatment device including a drum rotationally supported within the razor treatment device, at least two cam members supported within the razor treatment device, at least two guide members configured to cooperate with the cam members to expose the blade, and a first actuating member configured to effect rotation of the guide members. The head includes a cover for housing a blade and the cover is configured to expose the blade. The razor interfaces with the razor treatment device to move the cover of the razor to expose the blade.

Each cam member may define a cam track that guides linear retraction of the blade, rotational movement of the blade and cover, and linear extension of the blade into a position on the drum. The blade of the razor may be spring-biased in the cover. At least a portion of the drum may comprise an abrasive material. The razor may further include a pair of pins. Each pin may extend from an end of a longitudinal axis of the blade and extends out of the cover of the razor. The pins may be movable along the cam path of each cam member by each guide member in order to expose the blade in the razor treatment device.

Each guide member may be arcuate-shaped and define at least two recesses with surfaces configured to guide the pins along the cam path of each cam member. At least one latching mechanism may be positioned on at least one of a top surface of the cover and a bottom surface of the cover. At least one cradle member may be positioned on the head of the razor and configured to hold the spring-biased blade within the cover of the razor, wherein the blade may be spring-biased against the cradle member and may contact the cradle member at a portion that is abraded to position a cutting edge of the blade in a same position after each use of the treatment system. The abrasive material may be provided in a spiral configuration around the outer surface of the drum.

The razor treatment system may include a second drum having at least a portion of a surface thereof comprising an abrasive material. The razor treatment device may include a stropping portion. The stropping portion may include another rotatably mounted drum comprising a surface thereof comprising a material used to strop the blade.

In another embodiment, a shaving razor is provided. The shaving razor generally comprises a handle and a head. The head comprises a blade and a cover. The head is pivotally connected to the handle. The cover is configured to house the blade. The cover is rotatable relative to the handle to extend the blade from the cover.

In another embodiment, a razor treatment device is provided. The razor treatment device generally comprises a drum rotationally supported within a housing, at least two cam members supported within the housing, at least two guide members configured to cooperate with the cam members to interact with a shaving razor, and a first actuating member configured to effect rotation of the guide members.

Further details and advantages will be understood from the following detailed description read in conjunction with the accompanying drawings.

DESCRIPTION OF THE DISCLOSURE

Figure 1:
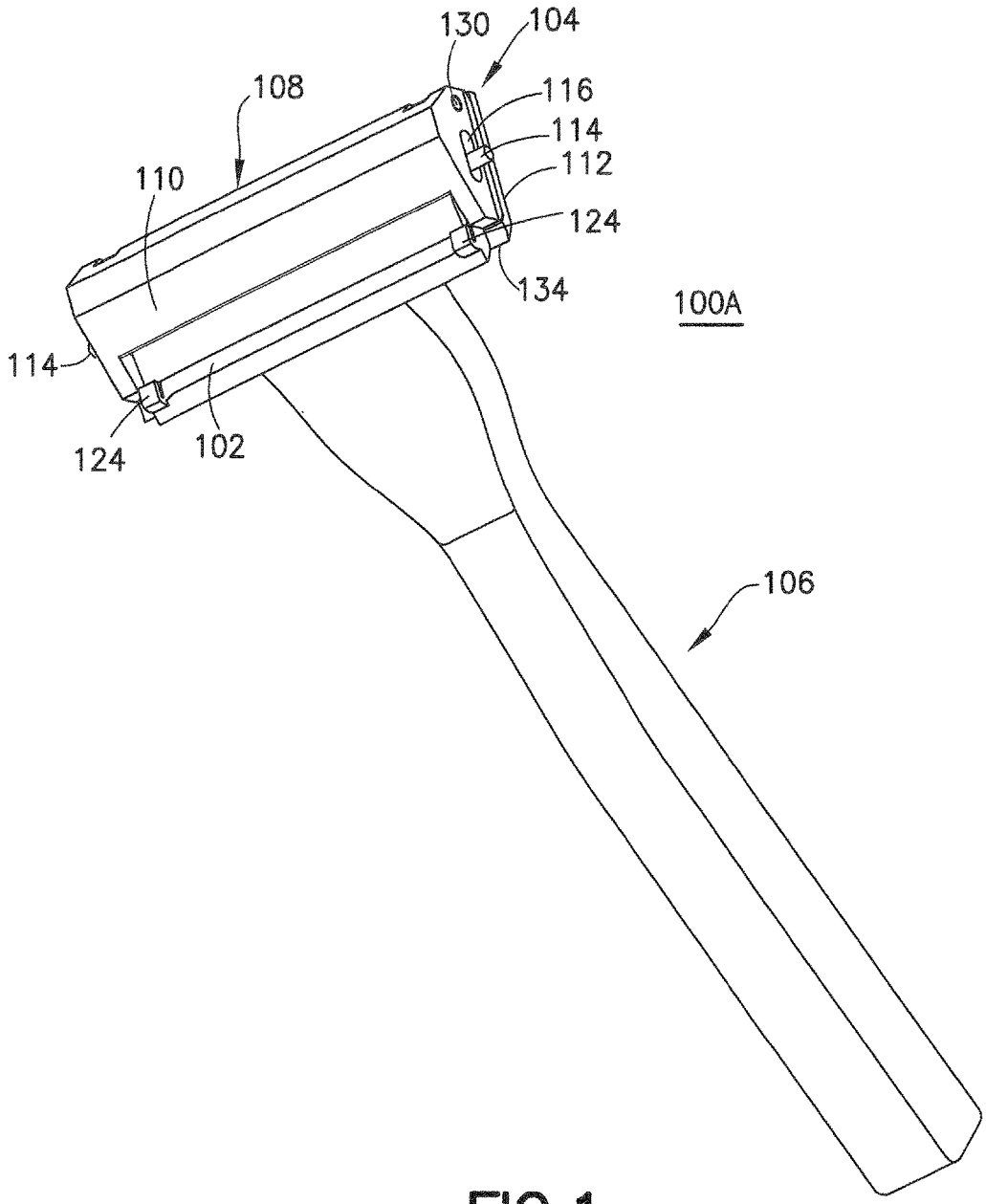
FIG. 1 is a perspective view of a razor according to this disclosure.

For purposes of the description hereinafter, spatial orientation terms, as used, shall relate to the referenced embodiment as it is oriented in the accompanying drawings, figures, or otherwise described in the following detailed description. However, it is to be understood that the embodiments described hereinafter may assume many alternative variations and configurations. It is also to be understood that the specific components, devices, features, and operational sequences illustrated in the accompanying drawings, figures, or otherwise described herein are simply exemplary and should not be considered as limiting. Further, unless otherwise stated, all other components within the sharpener and razor hereinbelow are duplicated on each side of the sharpener and razor so, although they may be discussed herein as a single component, the discussion applies equally to the analogous component on the opposite side of the sharpener or razor. Therefore, in the drawings several reference characters are used multiple times.

Figure 2:
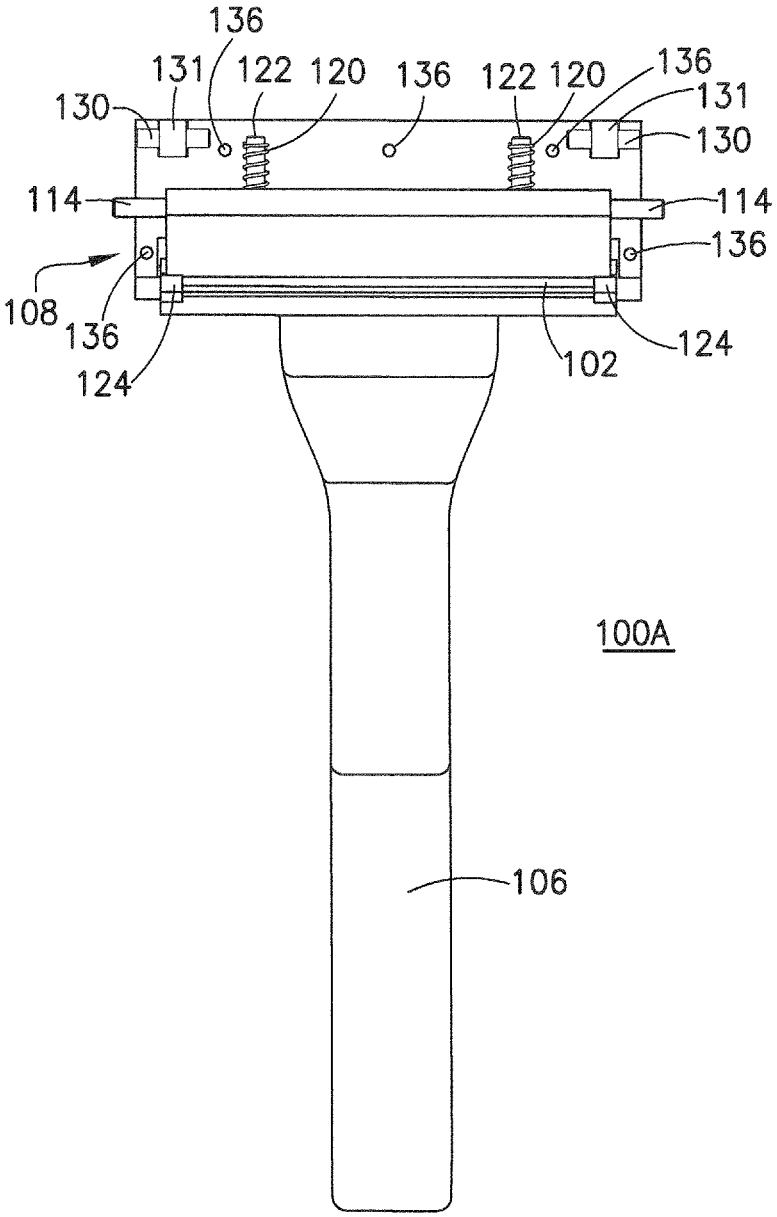
FIG. 2 is a bottom view of the razor of FIG. 1.
Figure 3:
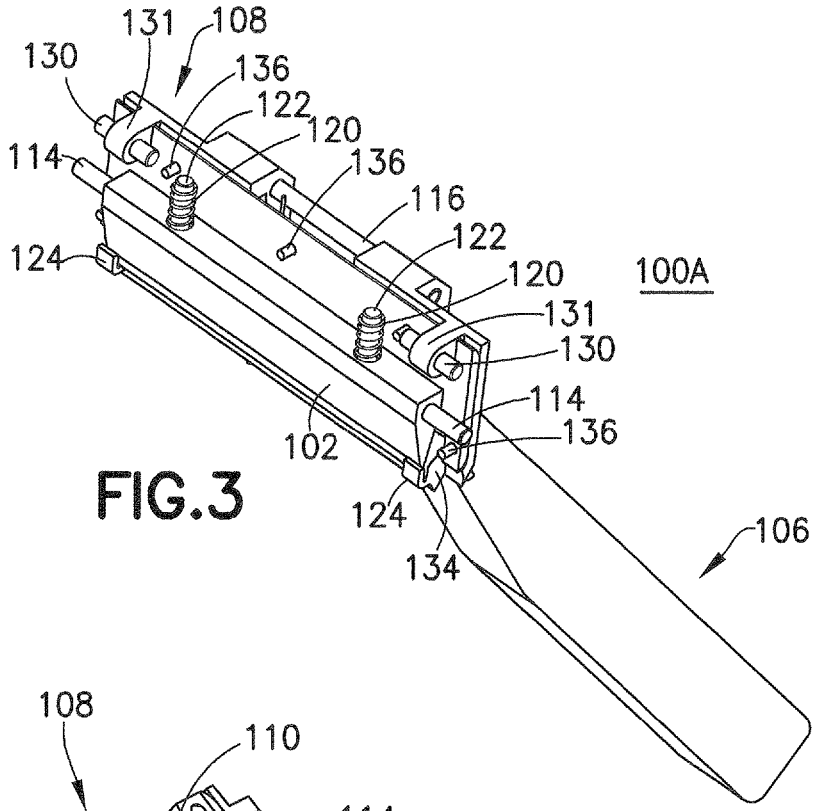
FIG. 3 is a perspective view of the razor of FIG. 1 depicting an exposed razor cover.
Figure 4:
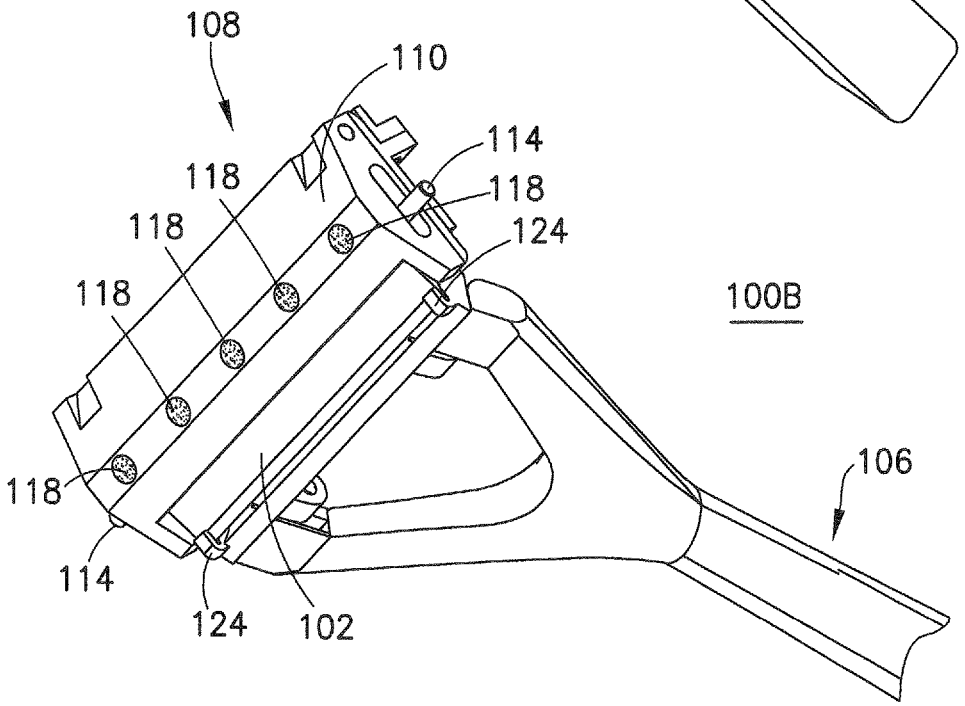
FIG. 4 is a bottom view of a razor according to this disclosure depicting magnets on a bottom surface of a razor cover.
Figure 5:
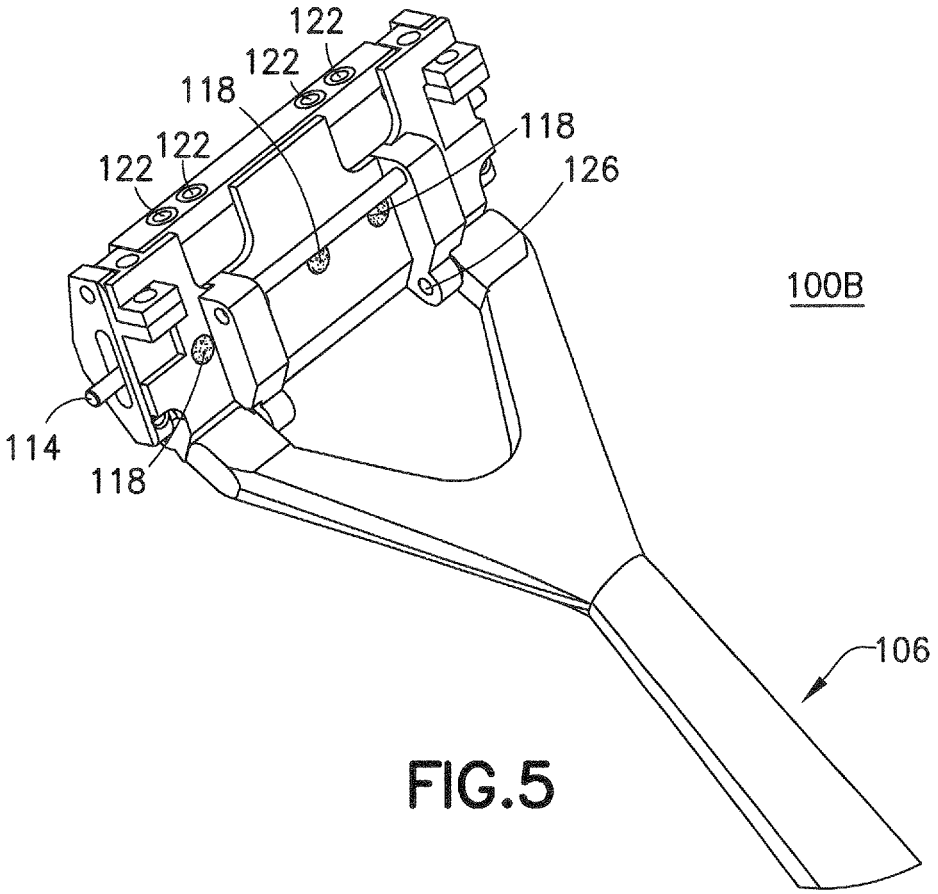
FIG. 5 is a perspective view of a top surface of the razor cover of FIG. 4.
Figure 6:
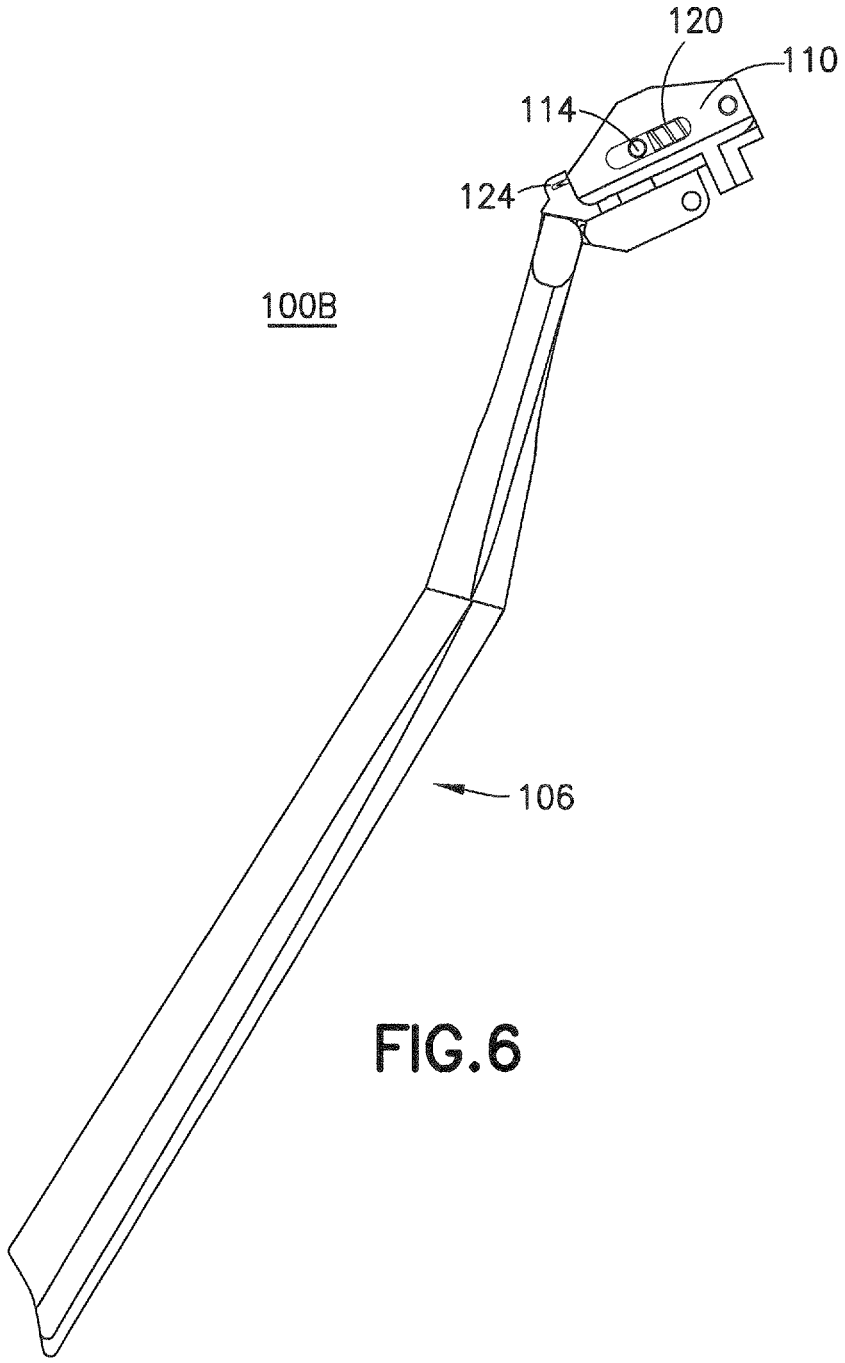
FIG. 6 is a side view of the razor of FIG. 1.
Figure 7:
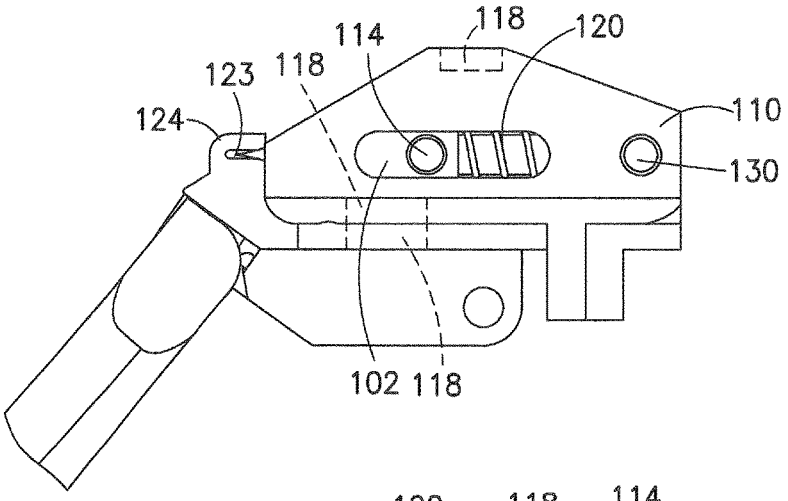
FIGS. 7-9 are side views of the razor cover of FIG. 1.
Figure 8:
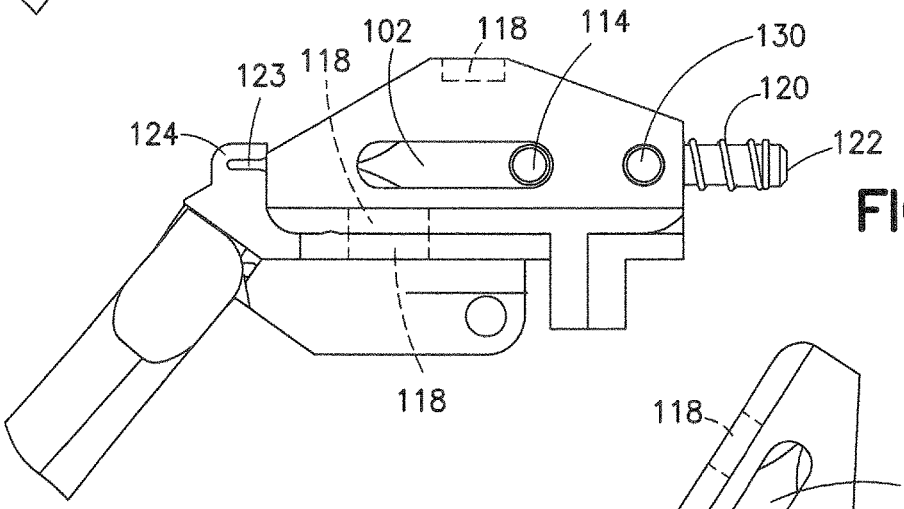

An embodiment of a razor 100A shown in FIGS. 1-3 (or in an alternative embodiment, 100B, shown in FIGS. 5-9) is disclosed with an extendable blade 102 such that the blade 102 can be exposed to be honed and/or stropped while remaining connected to a razor frame 104. As shown in FIGS. 1-9, the razor 100A, 100B comprises a handle 106 pivotally connected to a razor head 108, which includes the razor frame 104. The razor frame 104 includes a cover 110 and a frame back 112. The blade 102 is movably mounted within the razor frame 104 and is positioned with respect to the frame 104 so as to provide an appropriate shaving angle (typically between about 20 and 45 degrees between the blade 102 and a user's shaving surface). The blade 102 can be made of stainless steel or any hard, non-corrosive material (i.e., various metals, ceramic, etc.). Blade pins 114 extend from each side of the blade 102 through a slot 116 in each side of the cover 110. Screws 136 are used to secure portions of the frame 104 and head 108 together. In one embodiment, as shown in FIGS. 4-9, magnets 118 may be positioned within recesses defined in an upper surface of the cover 110 and/or a lower surface of the cover 110, as well as within recesses defined in the frame back 112 of the razor head 108. In one position, the magnets 118 on the lower surface of the cover 110 interact with the magnets 118 on the frame back 112 of the razor head 108. In this position, the magnets 118 are used to hold the cover 110 closed in the frame 104 of the razor head 108. In a second position, the magnets 118 on the top of the cover 110 interact with a cross member 424 (FIGS. 21-27) to keep the cover 110 open during treatment of the blade 102. This arrangement is explained in more detail below. Although these magnets 118 are shown as flush with the cover 110 and frame 104, it is contemplated that the magnets may be positioned further in or out of the respective structures. Alternatively, any type of mechanical latching mechanism that provides a retaining force may be interchanged with the magnets 118, for retaining the cover 110 in position while the blade 102 is honed, as described below.

Figure 10:
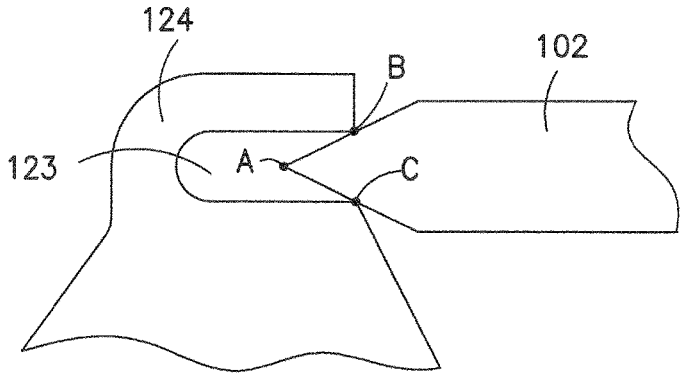
FIG. 10 is a side view of a cradle member of the razor of FIG. 1.
Figure 11:
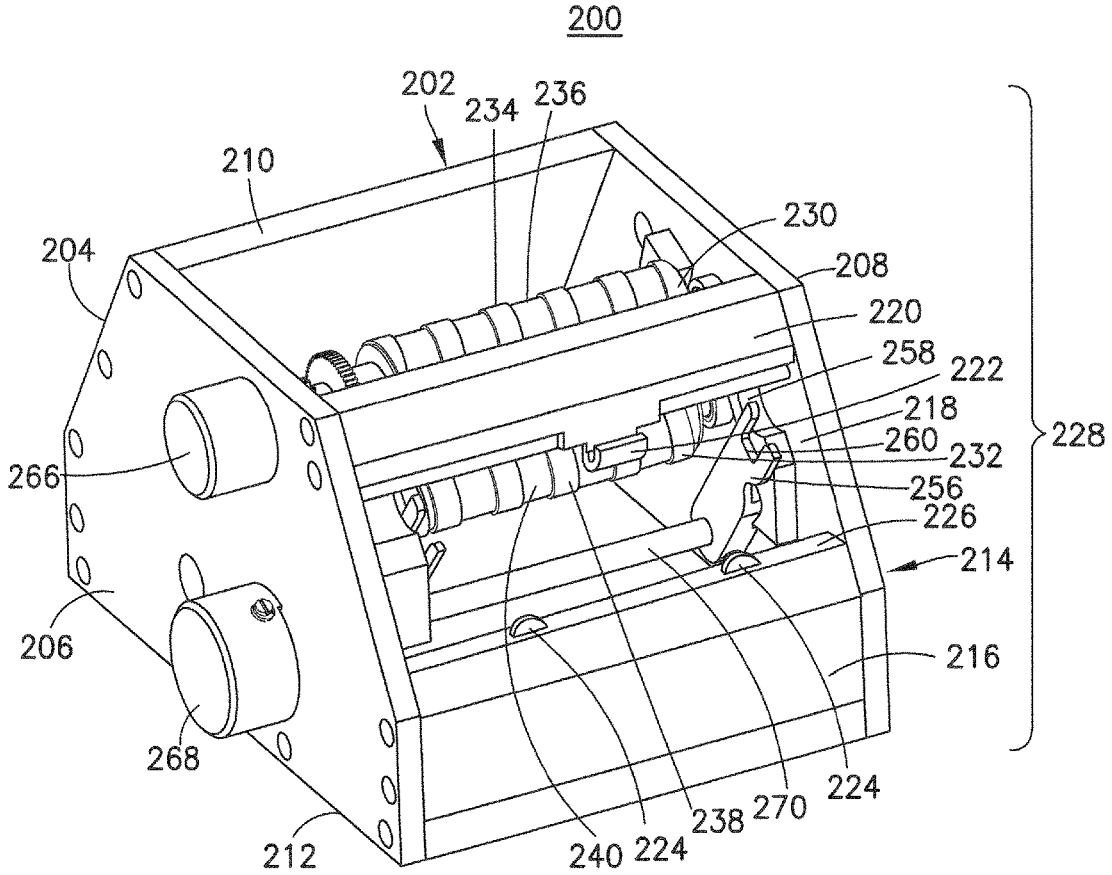
FIGS. 11 and 12 are perspective views of a razor treatment device according to this disclosure.
Figure 12:
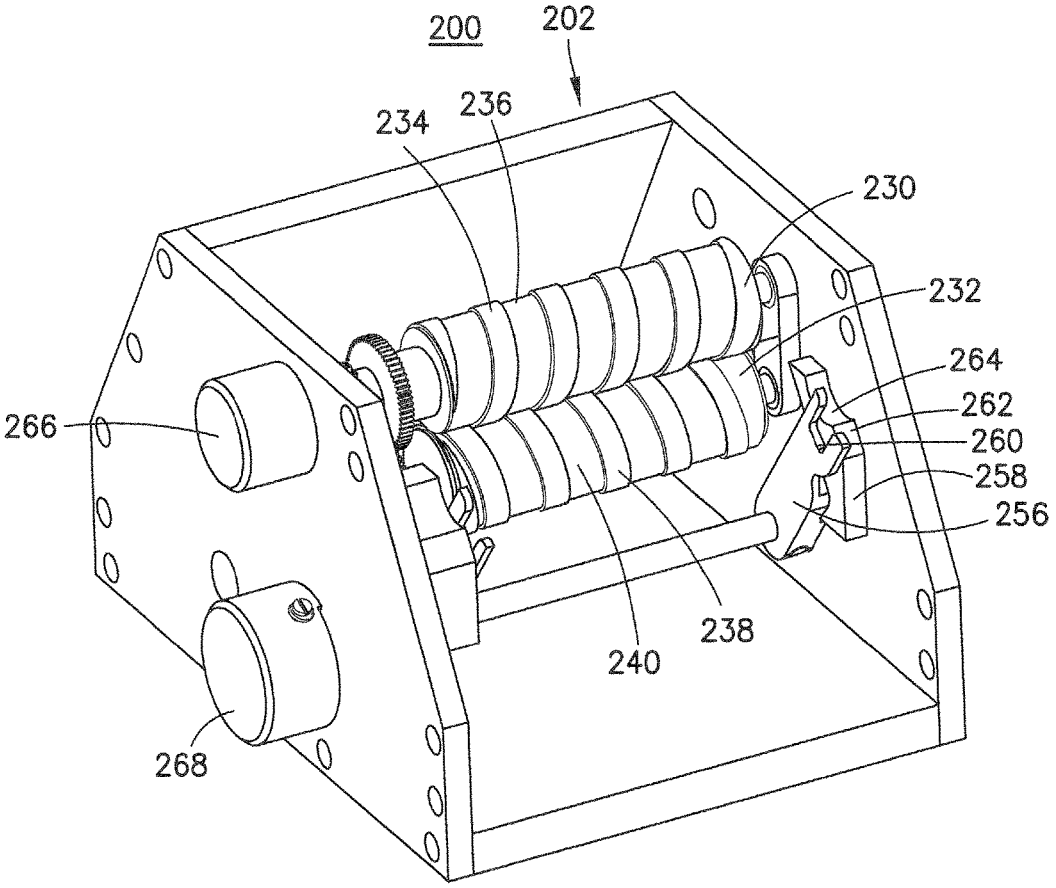
Figure 13:
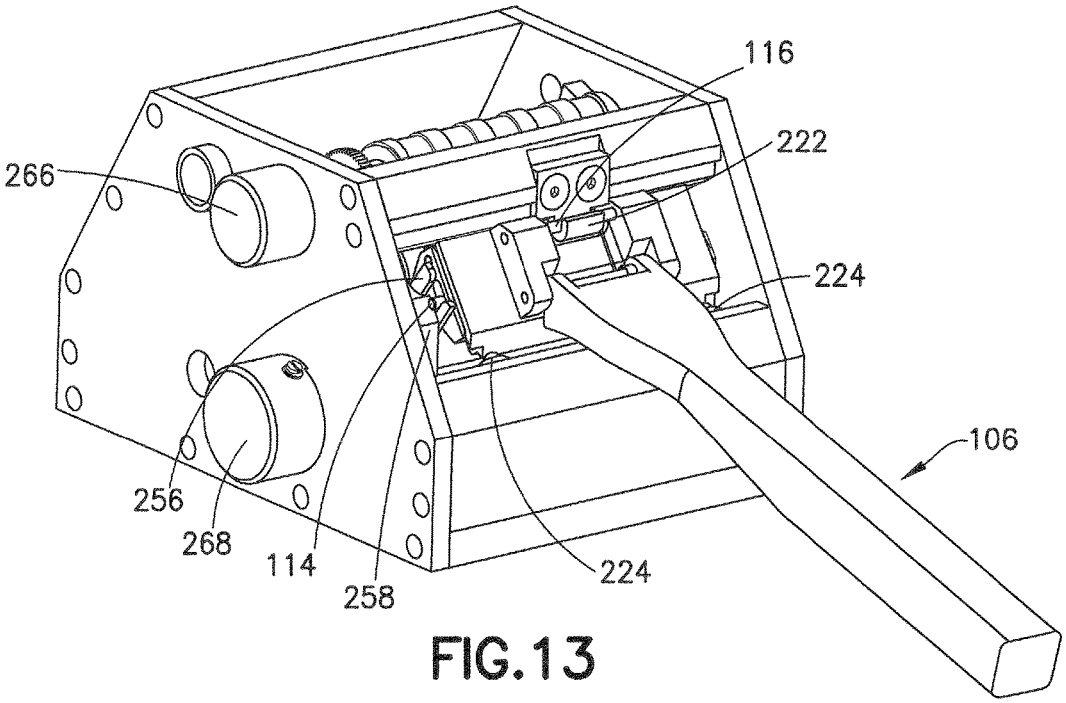
FIG. 13 is a perspective view of a razor treatment system according to one embodiment of this disclosure.
Figure 14:
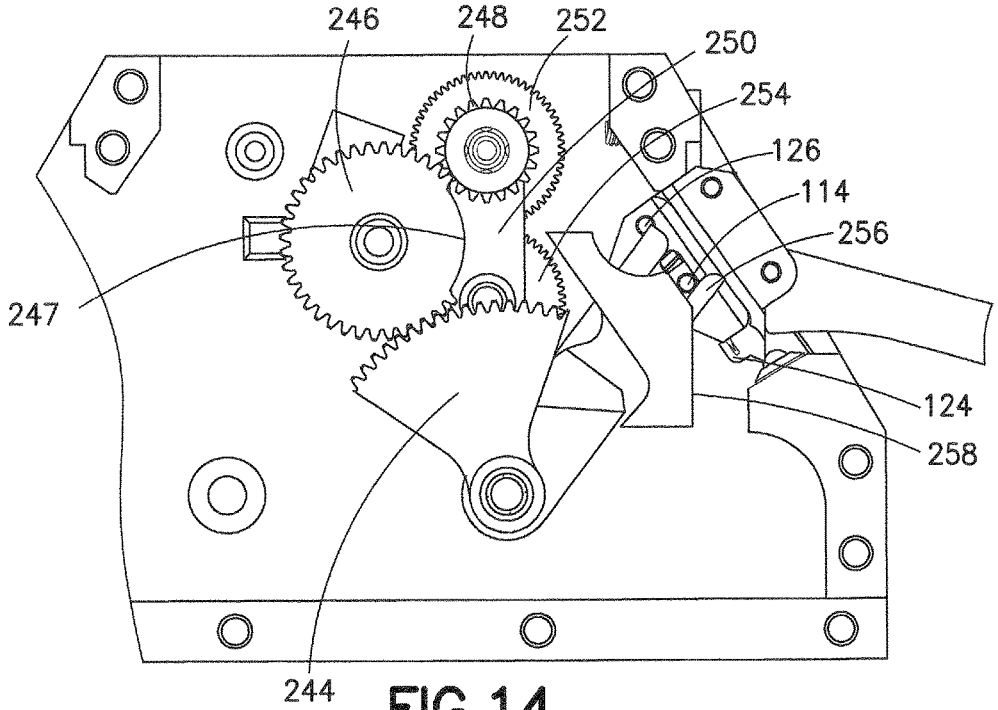
FIGS. 14 and 15 are cross-sectional views of the razor treatment device of FIGS. 11 and 12.

The blade 102 is biased forward within the frame 104 by springs 120 received on pins 122. A cutting edge of blade 102 is retained within pockets 123 defined in cradles 124 positioned on the frame 104. Spring-loading the blade 102 forward ensures that the blade 102 is in a desirable shaving position. This may be of particular importance since the process of honing the blade removes material from the edge of the blade 102. Therefore, slight adjustment of the blade 102 position within the frame 104 may be necessary after honing in order to retain the proper shaving position when the blade 102 is returned to its location within the frame 104. As shown in FIG. 10, the blade 102 is positioned in a desirable position for a preferred shaving position for the razor 100A, B. Point A is the cutting point of the blade 102. It is desirable to keep this point in the same position with respect to the cradle 124 (and by extension, the head 108 of the razor 100A, B). Points B and C are the contact points of the blade 102, which contact the cradle 124. As the blade 102 is sharpened, the blade 102 is shortened, thereby shifting the position of point A in the cradle 124. To compensate for the shortened blade 102, the springs 120 bias the blade 102 forward in the pocket 123 of the cradle 124 to position points B and C at the same contact point each time the blade 102 is retained in the cradle 124. The razor frame 104 is pivotally attached to the handle 106 via frame pins 126. A spring or other biasing member (not shown) extending from the frame 104 keeps the frame 104 biased forward and the frame pin 126 allows the frame 104 to pivot around an axis that runs through the frame pin 126, in order to accommodate the contours of the body surface during shaving while keeping the blade 102 at the correct angle relative to the skin. One end of this spring may be received within the frame 104 and an opposing end may be received within the razor handle 106.

Figure 9:
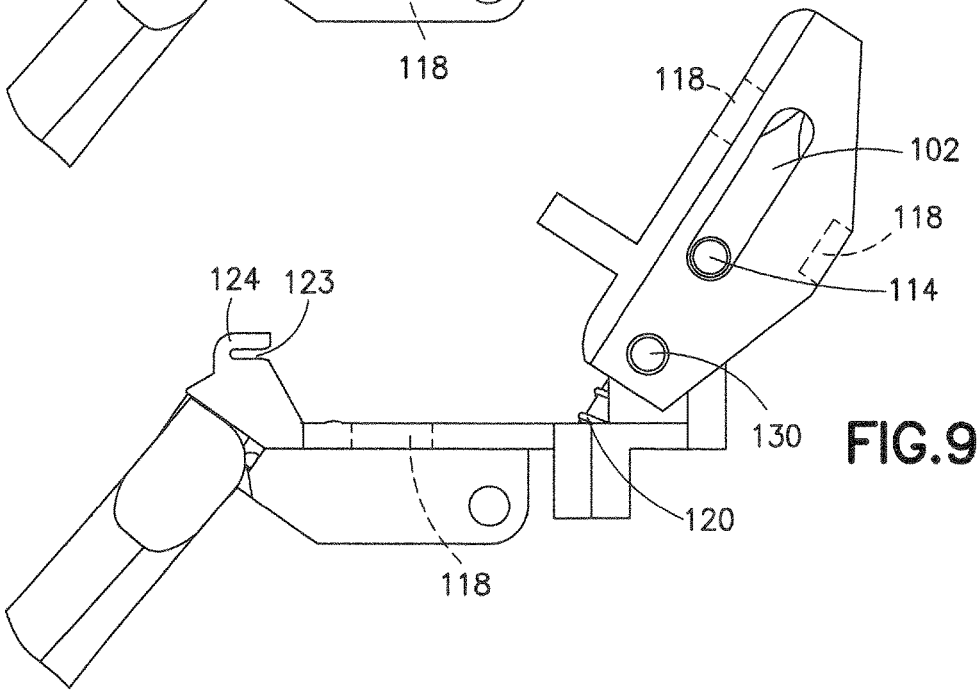

Cover pins 130 are positioned on an inside surface of cover 110, optionally extending from tabs 131. The cover 110 is pivotable around an axis extending through cover pins 130 such that cover 110 can open to expose the blade 102. Opening of the cover 110 is accomplished by movement of the blade pins 114 in a direction toward the cover pins 130 such that the springs 120 are compressed and the blade 102 is retracted. Upon retraction of the blade 102 (FIGS. 7, 8), the blade 102 moves out of pockets 123 of the cradles 124. When the blade 102 is not engaged in the pockets 123, the cover 110 is able to be moved away from the frame back 112 by pivoting the cover 110 around the cover pins 130 (FIG. 9). Once the cover 110 is open, the pins 114 can be released and will move away from the cover pins 130, thereby releasing the springs 120, resulting in expansion of the springs 120, once again biasing the blade 102 into a forward position Without the cradles 124 to restrain it, the blade 102 can extend forward and protrude from the cover 110.

Another embodiment of the invention includes a razor treatment device 200 for maintenance of the razor 100A, 100B. Referring now to FIGS. 11-14, the razor treatment device 200 includes a housing 202 comprising aback side 204, a left side 206, aright side 208, a top 210, and a bottom 212. The housing 202 also includes a front side 214 with a front panel 216, an opening 218, a cross bar 220 including a hook 222, and ball spring plungers 224. The ball spring plungers 224 are located on atop edge 226 of the front panel 216, opposite the hook 222 and may be spaced equidistant from the sides of the housing 202. It is also contemplated that the ball spring plungers 124 may be replaced with other suitable mechanisms suitable for snap fitting the razor head 108 within the housing 202.

Figure 17:
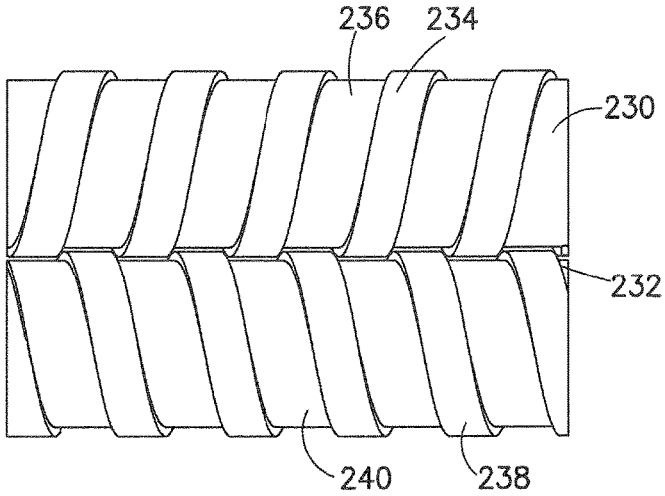
FIG. 17 is a perspective view of a pair of sharpening drums used in the razor treatment system.

Within the housing 202 is a portion 228 for honing the blade 102 of the razor 100A, 100B. Honing portion 228 includes an upper sharpening drum 230 and a lower sharpening drum 232 rotationally supported within the housing 202. As detailed below, blade 102 is received in between drums 230, 232. It is also contemplated that only one drum may be used to sharpen and/or strop the blade 102. As shown in FIG. 17, a raised sharpening surface 234 of the upper drum 230 is in the form of a ribbon that wraps around the drum 230 in a helical fashion. A non-sharpening surface 236 sits below and in-between the sections of the sharpening surface 234. The sharpening surface 234 of the upper drum 230 opposes a non-sharpening surface 240 of the lower drum 232. The non-sharpening surface 240 also is a ribbon that wraps around the drum in the alternate space from the sharpening surface 234. The non-sharpening surface 240 sits below and in-between the section of a sharpening surface 238 on the lower drum 232. Likewise, the non-sharpening surface 236 of the upper drum 230 opposes the sharpening surface 238 of the lower drum 232. Because the sharpening surfaces 234 and 238 are raised with respect to the non-sharpening surfaces 236 and 240, the sharpening surfaces 234, 238 of the opposite drums are able to overlap such that the sharpening surface 234 of the upper drum 230 extends into a gap defined by non-sharpening surface 240 of the lower drum 232. Likewise, the sharpening surface 238 of the lower drum 232 extends into a gap defined by the non-sharpening surface 236 of the upper drum 230. By providing a helical sharpening surface 234, 238 on each drum 230, 232, the drums 230, 232 are configured to engage or inter-engage with one another to create an overlap. This overlap may be desirable in order to maintain the desired angle on the razor blade 102 after sharpening of the blade 102. If the surface of the drums 230, 232 were flat and simply flush against each other, the angle of the blade 102 created by honing with those drums would approach zero degrees, while extremely sharp, a blade with this angle may be too fragile to cut well. The angle of a cutting tool is a balance between sharpness (smaller angle) and durability (larger angle). In some embodiments, the angle between a top surface and a bottom surface of the razor blade 102 is between 15 degrees and 20 degrees. In some embodiments, the angle of the razor blade 102 is 16 degrees. The overlap of the upper sharpening drum 230 and the lower sharpening drum 232 can produce the appropriate angle.

The helical aspect of the design accommodates sharpening of substantially the entire length of blade 102. As the drums 230, 232 rotate, the portions of the sharpening surfaces 234, 238 in contact with the blade 102 move down the entire length of the blade surface on both sides thereof. The sharpening surfaces 234, 238 of the sharpening drums 230, 232 may include a very hard material such as stone or a diamond coating, as is typically used for sharpening purposes.

Figure 15:
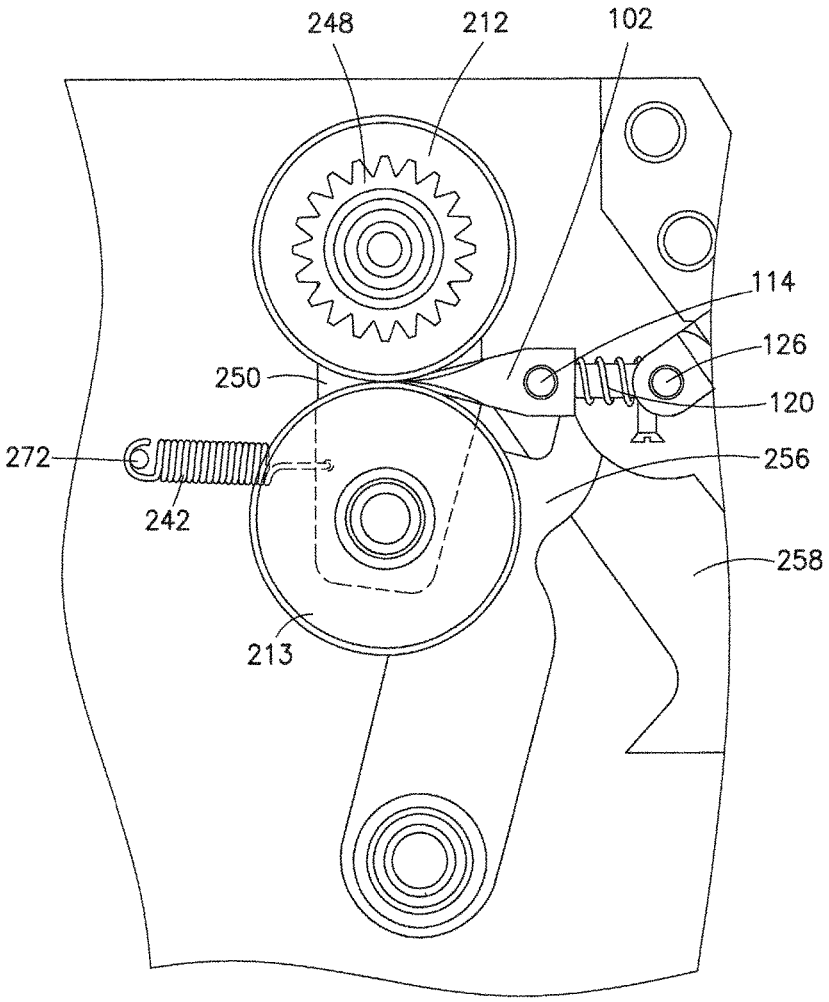

As shown in FIG. 15, the lower drum 232 is biased in a rearward position by a spring 242. The spring 242 is positioned on a member 272 of the housing 202 at one end and positioned on the linkage 250 at an opposing end. The spring 242 is biased so as to pull the linkage 250 rearward, thereby also biasing the lower drum 232 in a rearward position. This resting position may be desired so that when the razor 100A, 100B is engaged in the razor treatment device 200 and the cover 110 of the razor 100A, 100B is opened to expose the blade 102 for sharpening (see discussion below), the lower drum 232 is not in a position to block the opening of the cover 110 or the extension of the blade 102 out of the cover 110. The lower drum 232 is moved forward into the correct position once the blade 102 is in position for sharpening. The mechanics of the positioning of the lower drum 232 will be discussed in more detail below. In another embodiment, the lower drum 232 may be held stationary, without the spring 242 biasing the lower drum 232 in a rearward position. In this embodiment, however, the linear retraction of the blade 102 within the cover 110 is increased so that the blade 102 may clear the lower drum 232 upon insertion into the razor treatment device 200.

Also within the housing 202 are rotatably mounted gears 244, 246 and 248 (received on respective axles mounted to housing 202) and linkage 250 extending between gears 244 and a drum gear 254, which together compose a gear train that moves the lower drum 232 forward and into place for sharpening of the blade 102. Drum gears 252 and 254 are mounted on common axles with respective upper sharpening drum 230 and lower sharpening drum 232, with the drum axles mounted to housing 202.

Unless otherwise stated, all other components within the housing 202 are duplicated on each side of the razor treatment device 200 so, although they may be discussed herein as a single component, the discussion applies equally to the analogous component on the opposite side of the razor treatment device 200. Also contained in the housing 202 are two forked guide members 256, one on either side of the pair of drums 230, 232. Each forked guide member 256 is associated with a cam track 258. As will be discussed in further detail, the forked guide member 256, when biased in a forward position, engages the pin 114 on the blade 102 within a forked end 260 of the forked guide member 256 when the razor 100A, 100B is inserted in the razor treatment device 200. As the forked end of the forked guide member 256 is moved rearward, the associated blade pin 114 is pushed along with the forked guide member 256. The blade pin 114 rides on a surface of the cam track 258 as it moves rearward. This arrangement results in the opening of the cover 110 and release of the blade 102 for sharpening, as described in more detail below. The cam track 258 includes a first run 262 and a second run 264. The forked guide members 256 are biased forward via a coil spring or the like incorporated into an actuating member 268, configured such that rotation of the actuating member 268 rotates the forked guide members 256. When the razor 100A, 100B is removed from the razor treatment device 200, the forked guide members 256 move forward automatically and are in place and available to receive the blade pins 114 the next time the razor 100A, 100B is inserted in the razor treatment device 200.

The razor treatment device 200 includes two actuating members 266, 268 which may be located on a side of the razor treatment device 200. The actuating members 266, 268 are shown as knobs, but may be replaced by levers or any other mechanism to impart movement from the user to the appropriate components within the razor treatment device 200, and/or they may be positioned in any location on the razor treatment device 200 provided they are able to perform the appropriate functions as described herein. One actuating member 268 connected to forked guide members 256 by rod member 270 may be turned by the user after the razor 100A, 100B has been latched into the razor treatment device 200. Movement of actuating member 268 is converted to movement of the forked guide members 256 by rotation of rod member 270, which engages and moves the blade pins 114, and also to movement of the lower drum 232 into the correct position for sharpening.

The second actuating member 266 may be turned by the user once the blade 102 is extended and in place for sharpening. This actuating member 266 turns the drums 230, 232 so that the blade 102 is sharpened by the movement of the sharpening surfaces 234, 238 along each side of the blade 102. This process will be discussed in further detail hereinbelow. In some embodiments, the actuating member 266 may include a slip clutch to prevent the actuating member 266 from being turned in the wrong direction, which could damage the blade.

Figure 16:
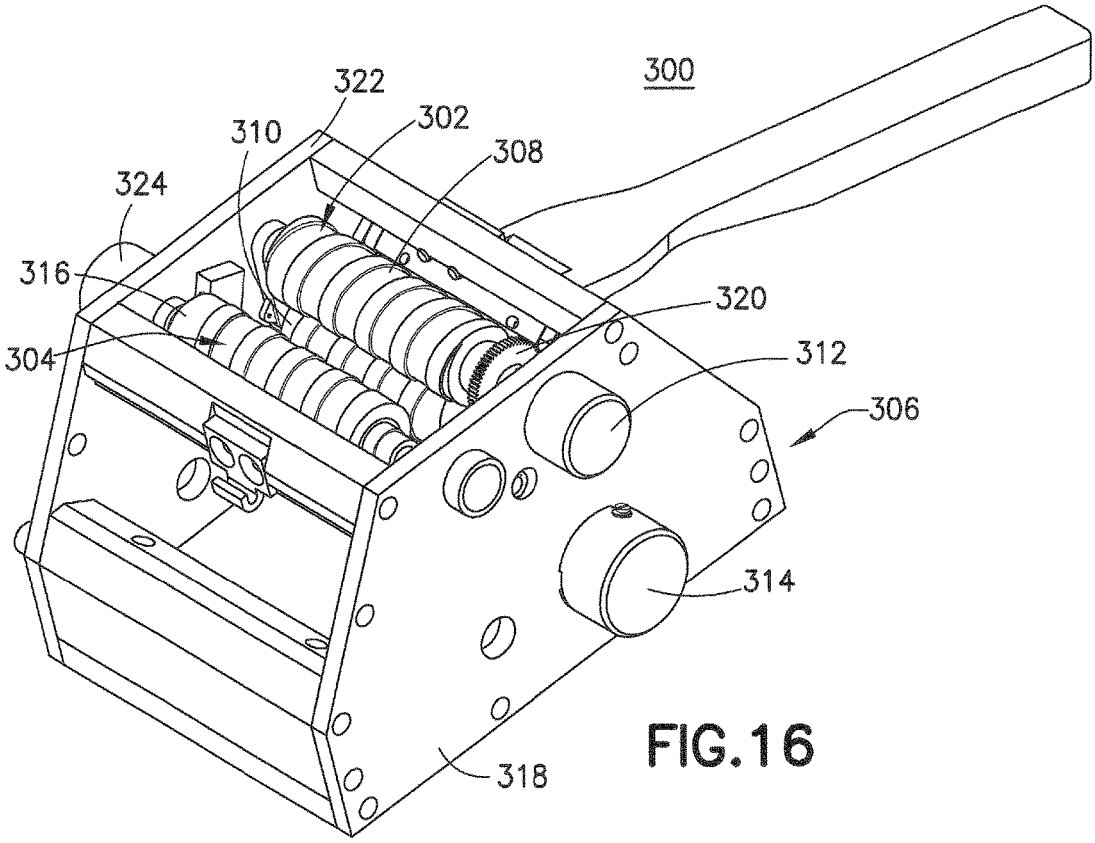
FIG. 16 is a perspective view of the razor treatment system of FIG. 13.
Figure 36:
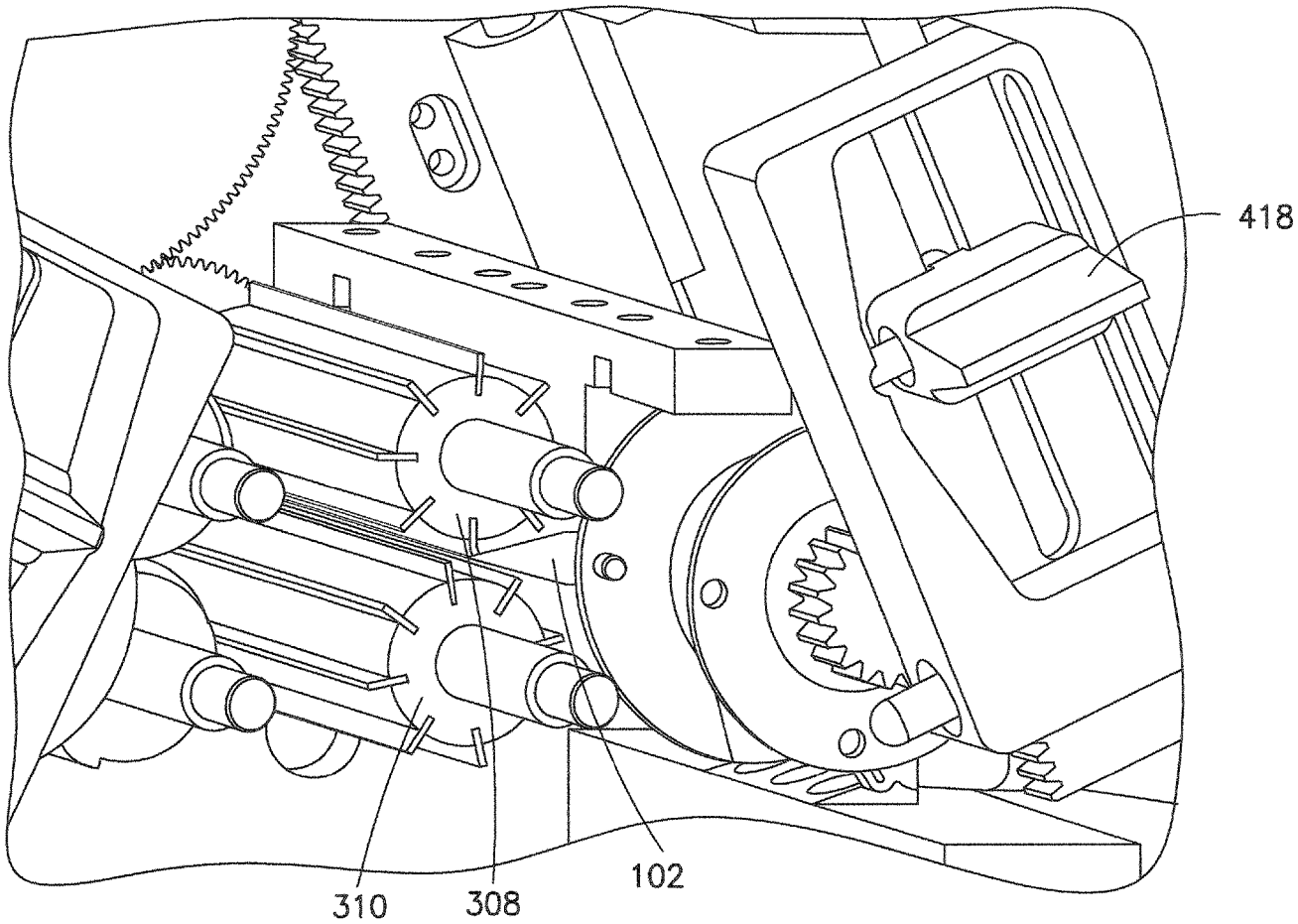
FIG. 36 is a perspective view of a pair of stropping drums used in the razor treatment system.

In some embodiments, as shown in FIG. 16, the razor treatment device 300 includes a stropping portion 302. For the purposes of this discussion, the stropping portion 302 is located opposite the honing portion 304 within the housing 306 of the razor treatment device 300 but can be located elsewhere, as desired. For example, the stropping portion 302 may be located above or below the honing portion 304. The stropping portion 302 has the same or similar mechanical arrangement and mechanical functions as described for the honing portion 304 except for the differences described herein. As shown in FIG. 36, the drums 308, 310 of the stropping portion 302 may be made of rubber, leather, or other suitable material that will bend the edge of the blade 102 back to true. Alternatively, the drums 308, 310 may be coated with an extremely fine abrasive material that can polish and bend the edge of the blade 102, as opposed to the abrasives that remove larger amounts of material from the edge of the blade 102 as would be used for honing. This extremely fine abrasive material may be a paste or polishing compound that may be externally applied to the drums 308, 310 to achieve a very fine abrasion. Once the razor head 108 is inserted into the opening of the stropping portion 302 of the razor treatment device 300 and the blade 102 is released and extended to contact the stropping drums 308, 310 by turning of a lower actuating member 314 connected thereto, the stropping drums 308, 310 are turned in a similar fashion as the sharpening drum 316. However, as viewed from the right side 318 of the razor treatment device 300, an upper actuating member 312 of the stropping portion 302 is turned in a clockwise direction to rotate the upper stropping drum 308 in a clockwise direction. The upper stropping drum gear 320 rotates in a clockwise direction with the upper stropping drum 308 and imparts a counterclockwise rotation to a lower stropping drum gear (not shown). The lower stropping drum gear is associated with the lower stropping drum 310, which also rotates in a counterclockwise direction. This concerted movement of the stropping drums 308, 310 results in straightening of the edge of the blade 102. As opposed to honing, no material is removed from the blade 102 in the stropping process, but the existing blade edge is bent back to a straight form.

The honing of the blade 102 and the stropping of the blade 102 are performed in opposite directions. When the blade 102 is honed, the sharpening drums 230, 232 are rotated "into" the blade 102. When the blade 102 is stropped, the drums 230, 232 are rotated "away" from the blade 102. This opposite direction of rotation lends itself to having only one user input actuating member to rotate both sets of drums in their respective directions, even if the razor 100A, 100B is only engaged in one side of the razor treatment device 200. This reduces the number of actuating members needed for rotating the drums and reduces the cost of manufacturing such device. This also helps to eliminate user confusion as to which actuating member is used to rotate which set of drums. In order to ensure the user rotates the actuating member in the correct direction, a slip clutch (or similar anti-rotational device) may be incorporated so the actuating member 266 can only be turned in one direction.

It should be noted that, while the actuating members 312, 314 are shown as being located on the right side 318 of the razor treatment device 300, the actuating members 312, 314 may alternatively be located on the left side 322. This alternative location of the actuating members 312, 314 would require suitable alteration of the gear train associated with these actuating members 312, 314 and the stropping drums 308, 310, as would be known to one skilled in the art, in order to produce the proper rotation of the stropping drums 308, 310 required to straighten the blade edge (i.e., clockwise rotation of the upper stropping drum 308 and counterclockwise rotation of the lower stropping drum 310 as viewed from the right side 318).

In another alternative embodiment, as shown in FIGS. 18-35, the forked guide members 256 are replaced with a different type of guide members. These arcuate guide members 402, along with the cam track 257, provide for similar blade motion as the forked guide member 256 and the cam track 258. The cam track 257 remains stationary and positioned on the sharpener 200 while the blade pins 114 ride along the surface of the cam track 257. In contrast, the arcuate guide members 402 rotate to engage the blade pins 114 and move the blade pins 114 over the cam track 257 surface. The arcuate guide members 402 are arcuate-shaped and define at least two recesses 404, 406 defining surfaces 408, 410 to receive the blade pins 114. The blade 102 may be retracted back into the cover 110 by rotating the arcuate guide member 402 in an opposite direction, so as to move the blade pins 114 along the surface of an opposing recess.

Figure 18:
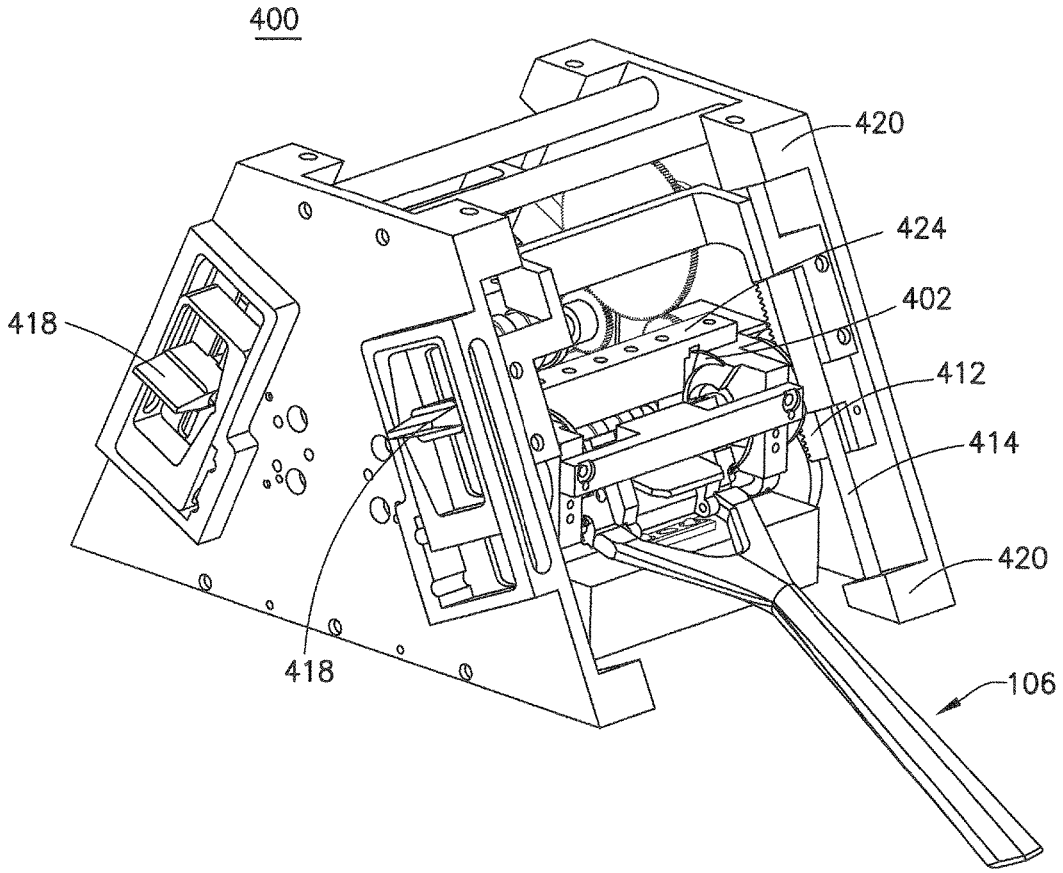
FIG. 18 is a perspective view of another embodiment of a razor treatment system according to this disclosure.
Figure 19:
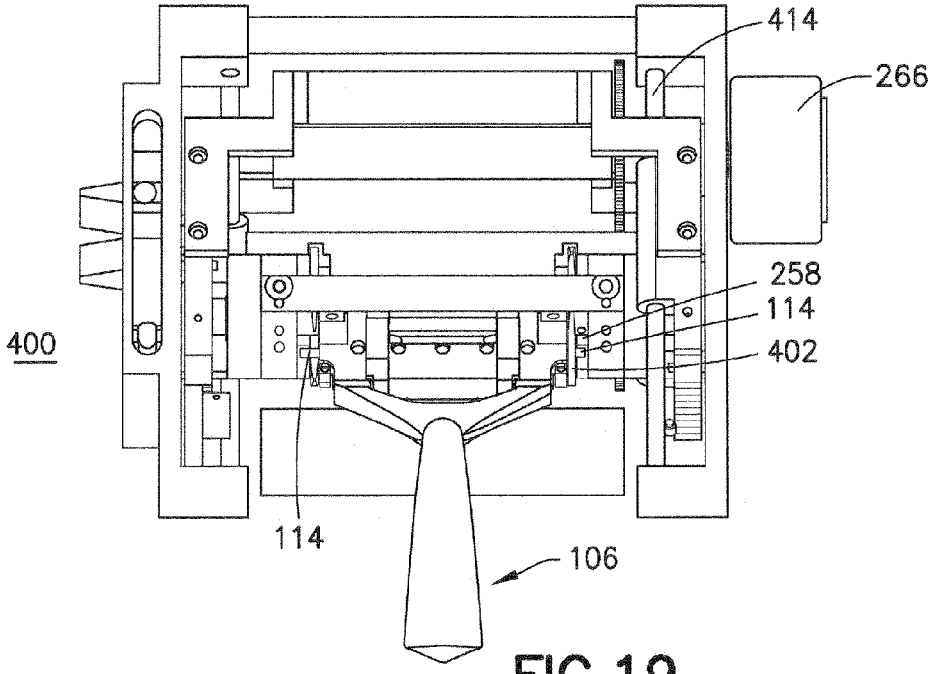
FIG. 19 is a front view of the razor treatment system of FIG. 18.
Figure 20:
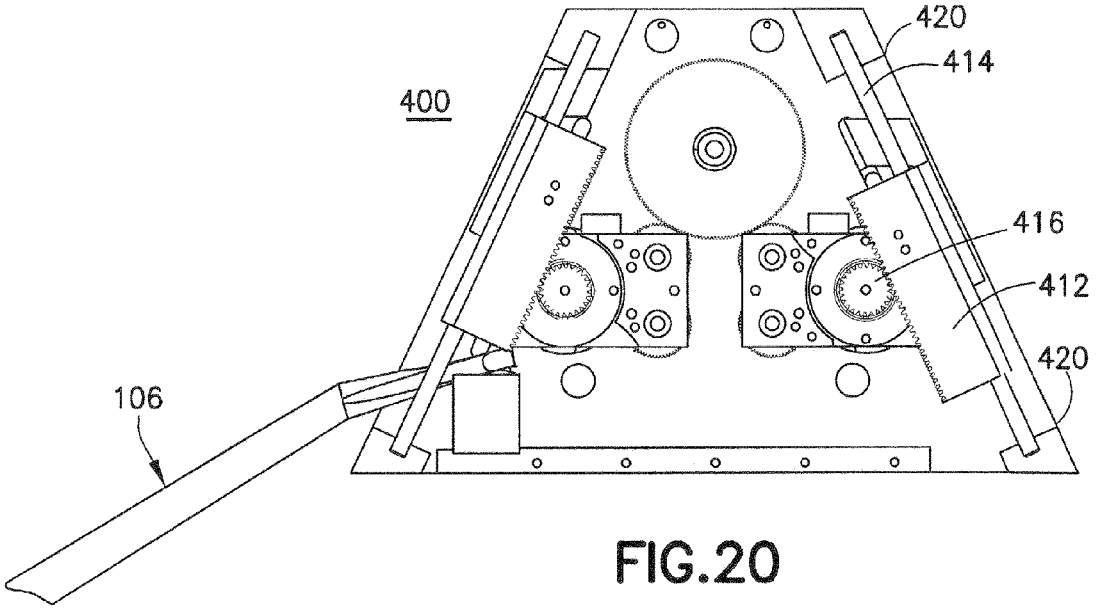
FIG. 20 is a cross-sectional view of the razor treatment system of FIG. 18.
Figure 21:
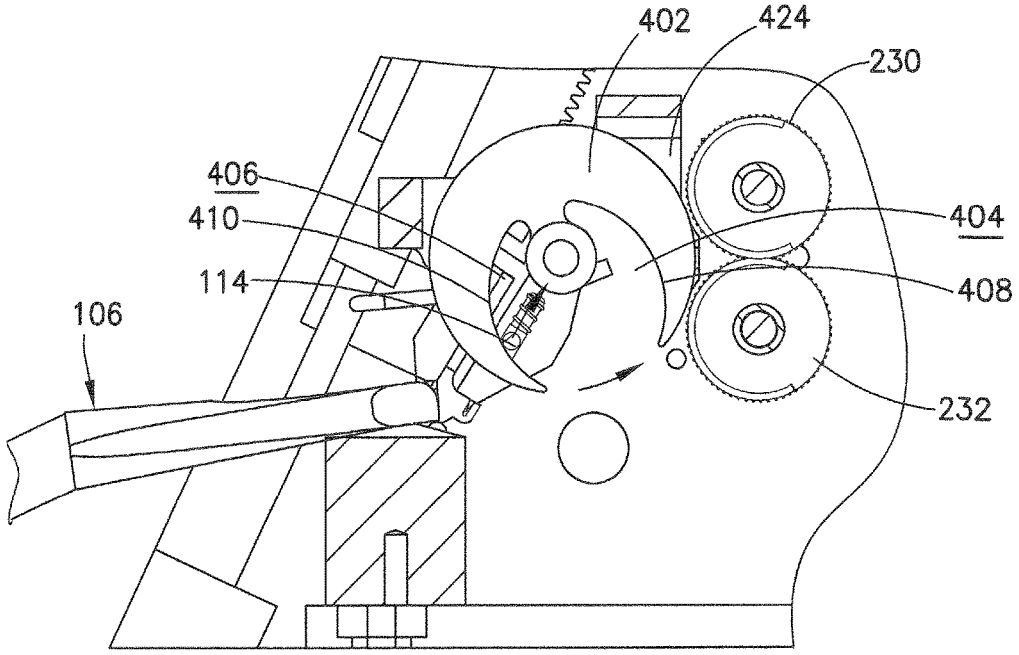
FIGS. 21-27 are cross-sectional views of the razor treatment system of FIG. 18 depicting the movement of a blade and cover of a razor along a cam track within the razor treatment system.
Figure 22:
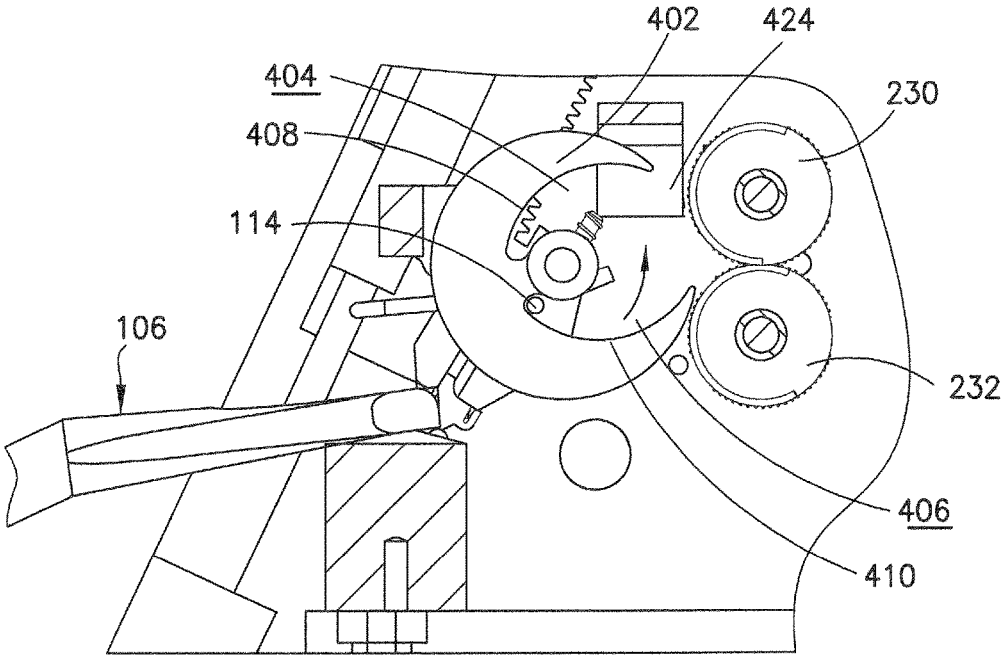
Figure 23:
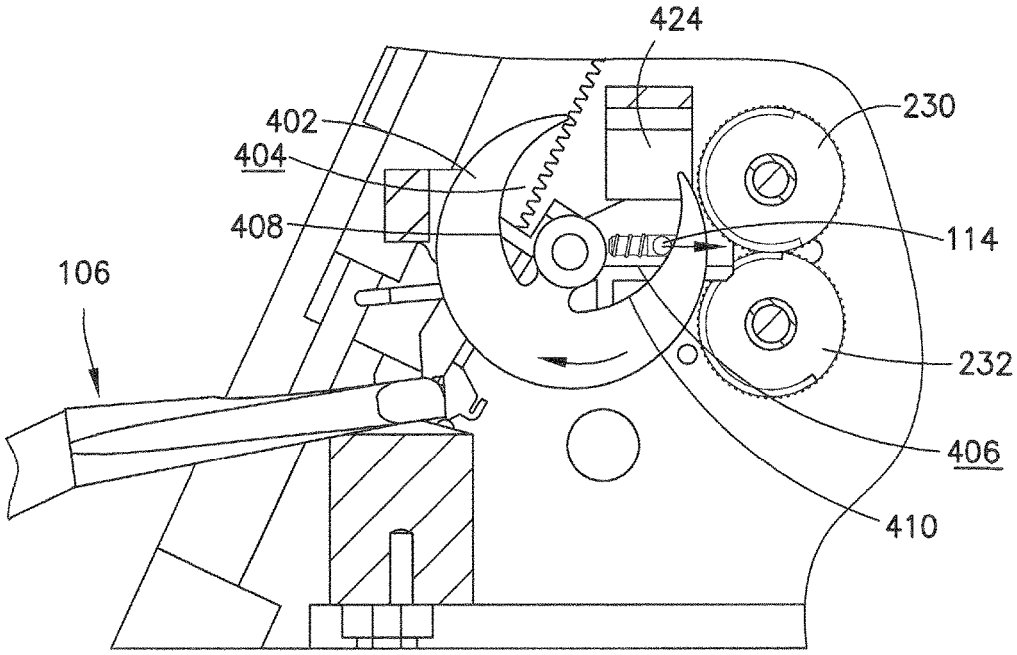
Figure 24:
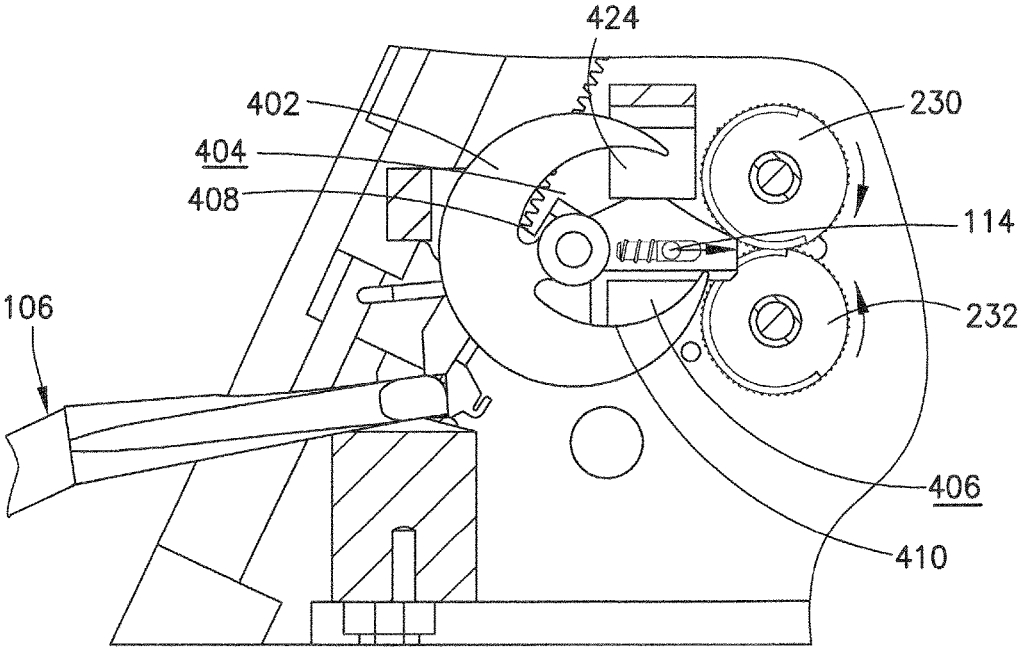
Figure 25:
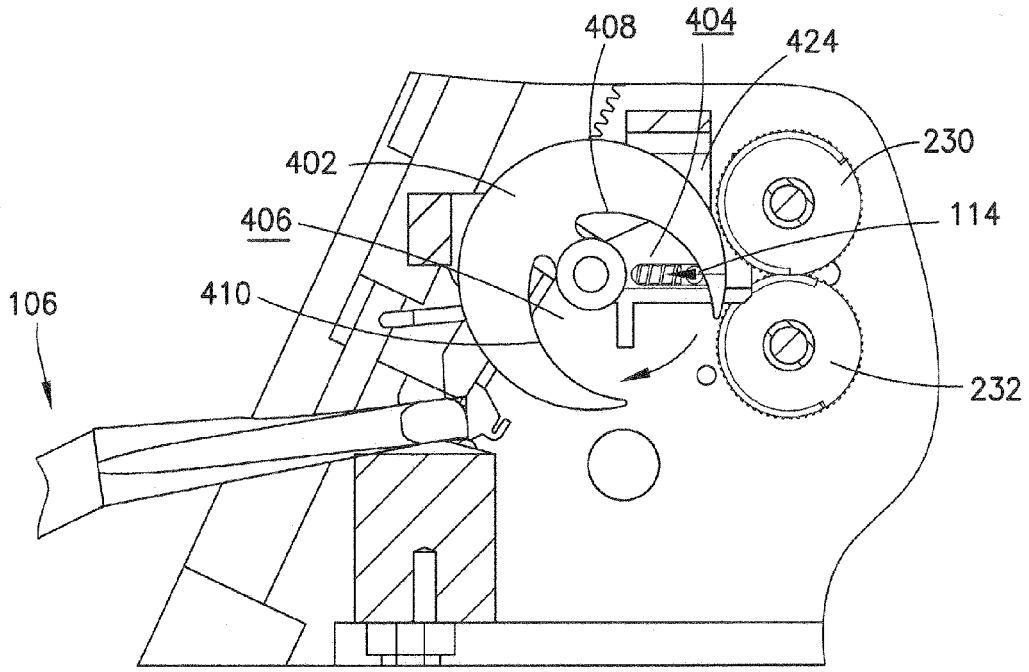
Figure 26:
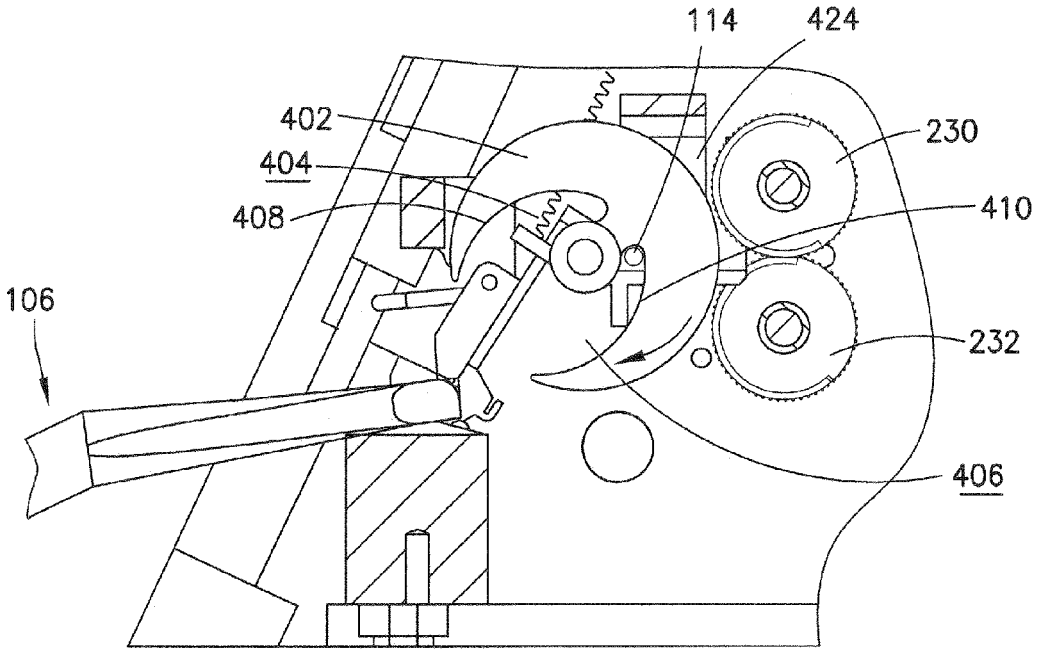
Figure 27:
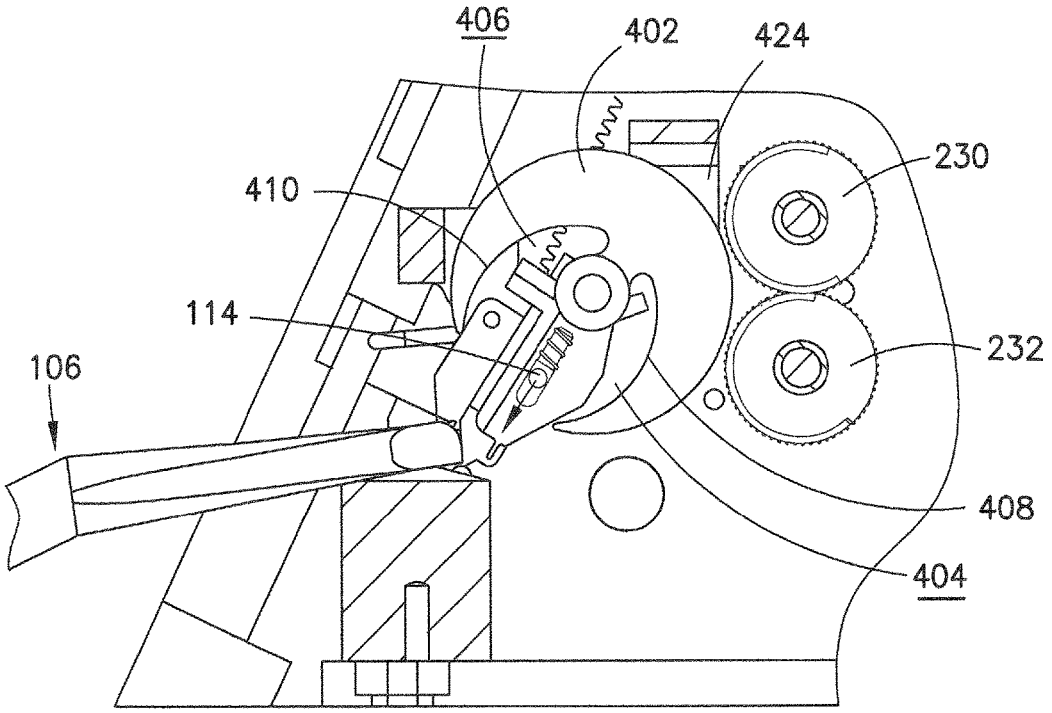
Figure 28:
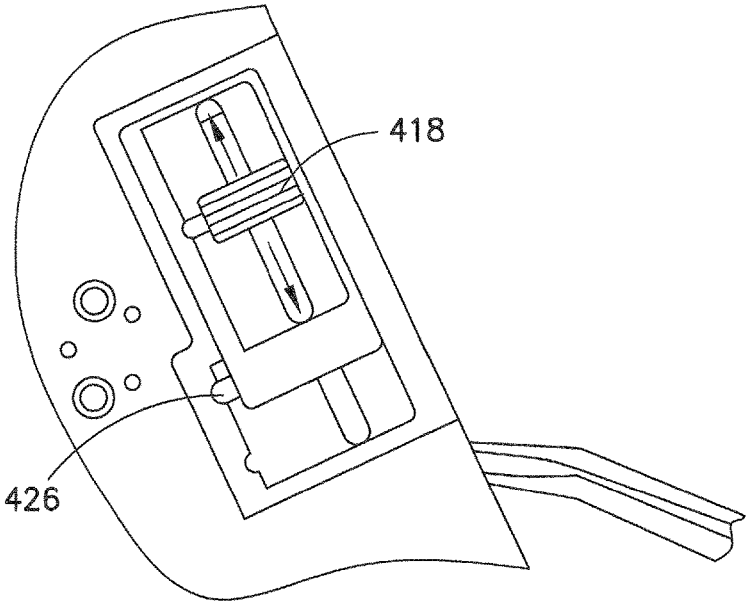
FIG. 28 is a sectional view of the razor treatment system of FIG. 18 depicting an actuating member used on the razor treatment system.
Figure 29:
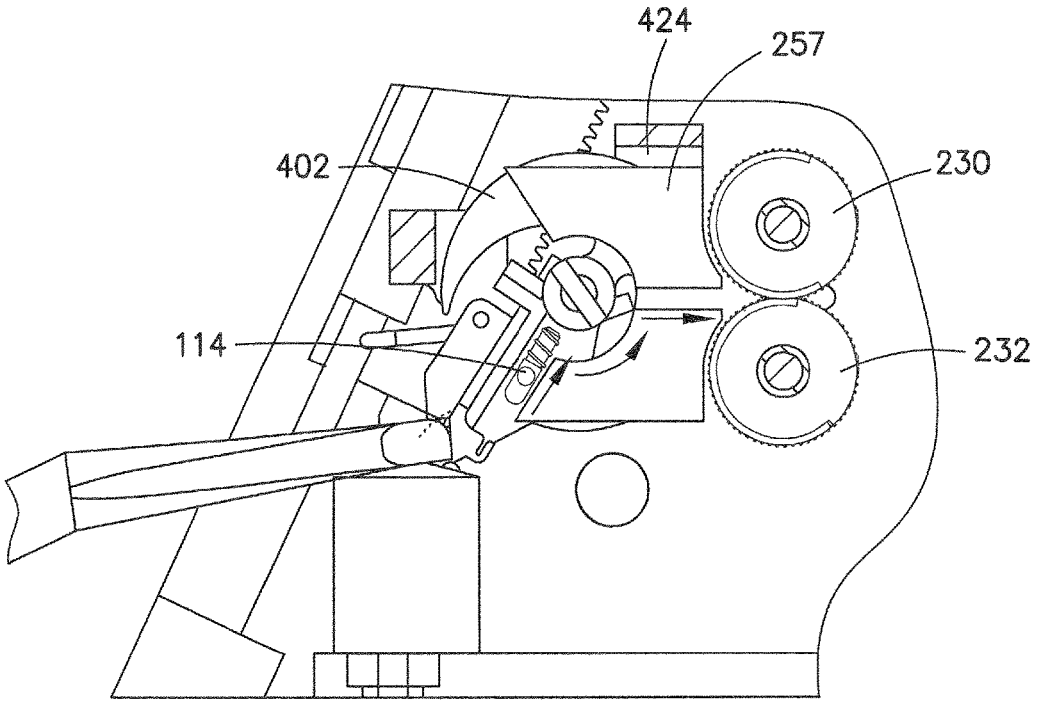
FIGS. 29-34 are cross-sectional views of the razor treatment system of FIG. 18 depicting the movement of a blade and cover of a razor along a cam track.
Figure 30:
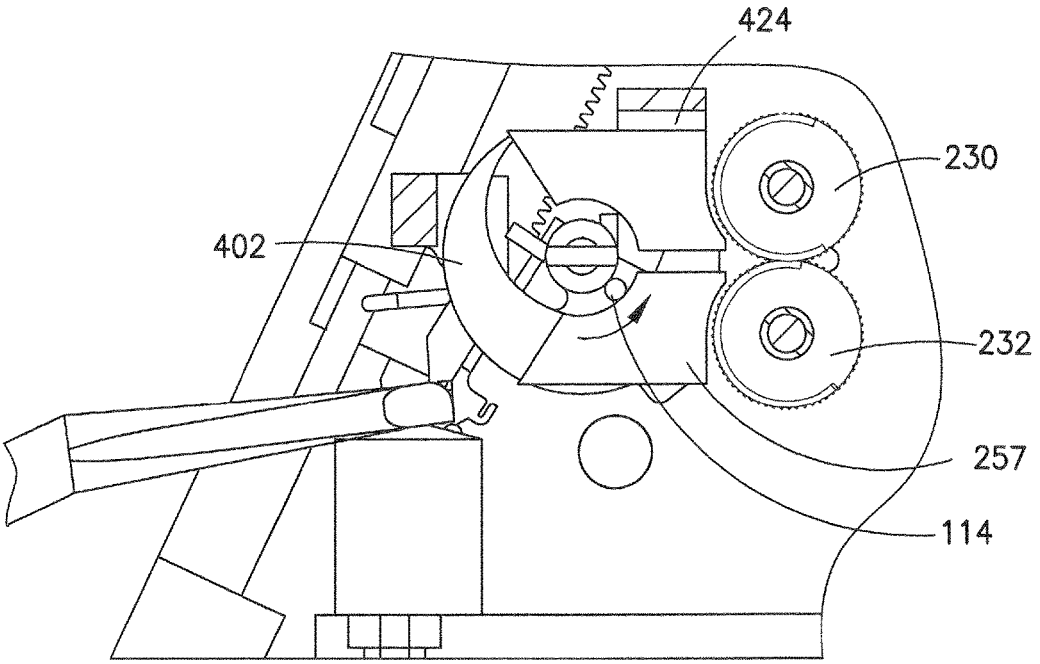
Figure 31:
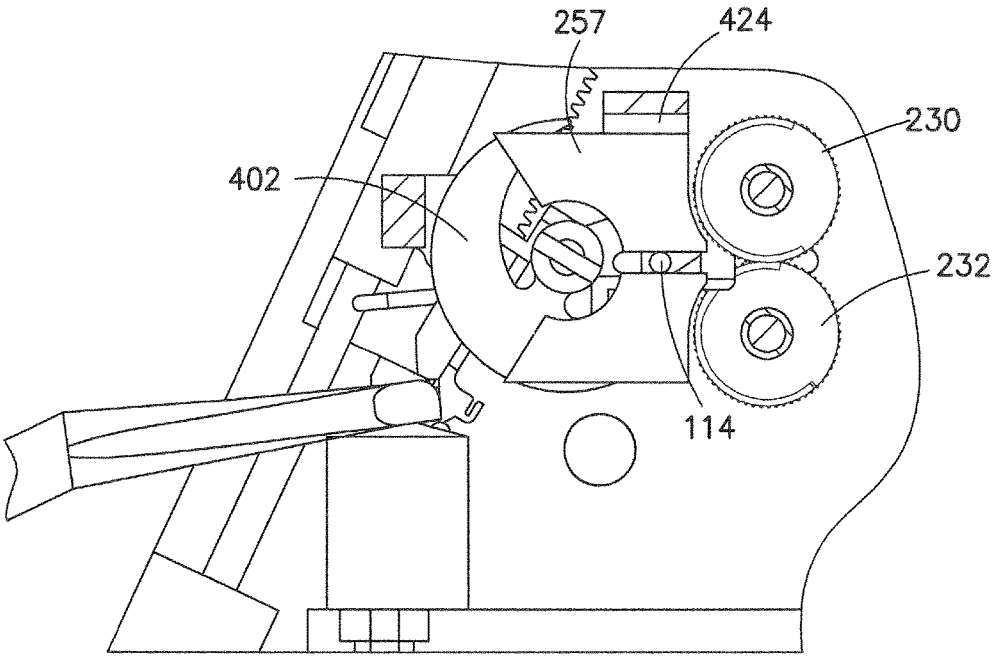
Figure 32:
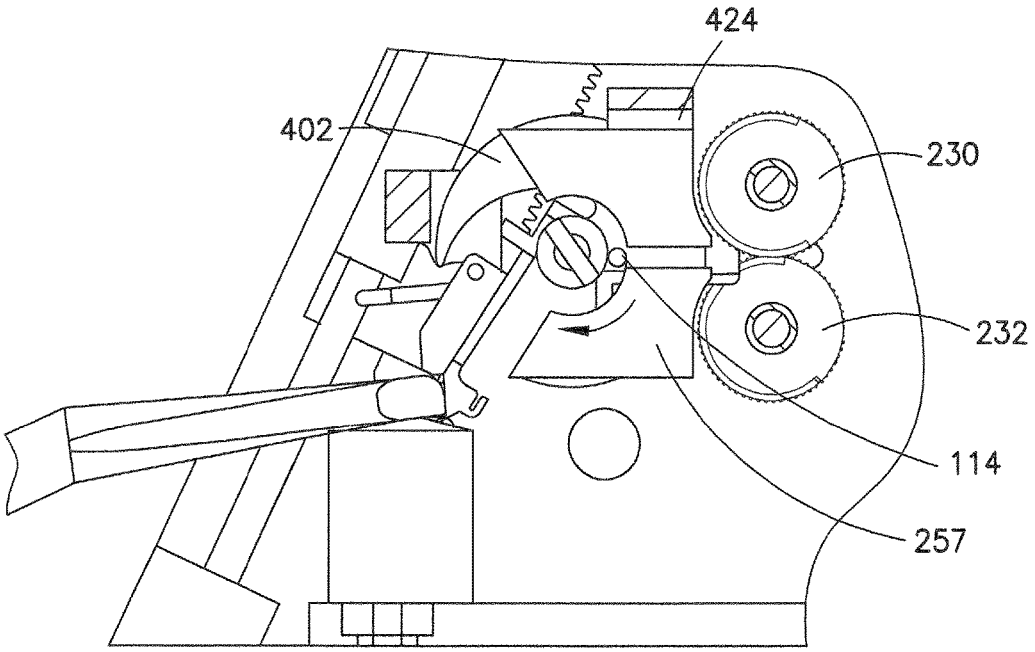
Figure 33:
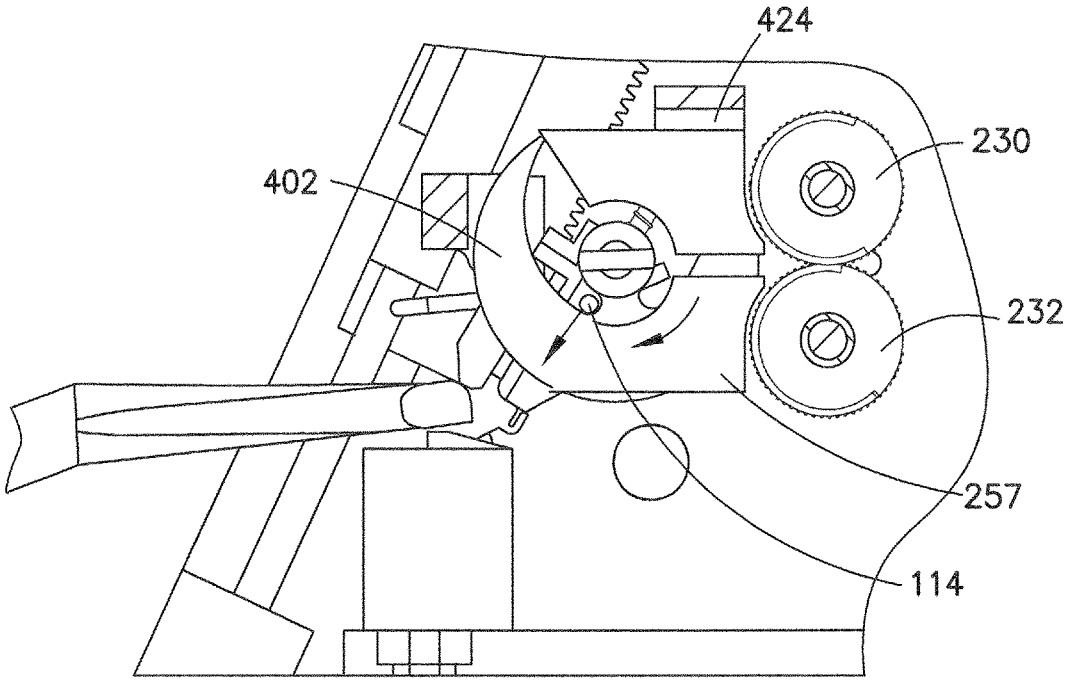
Figure 34:
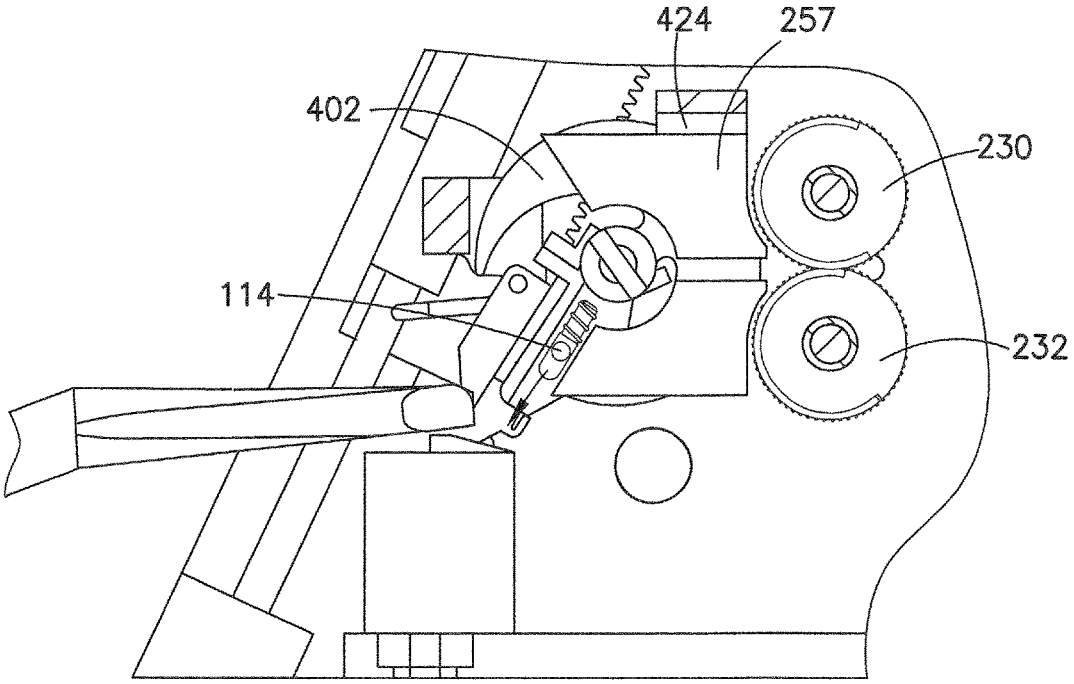
Figure 35:
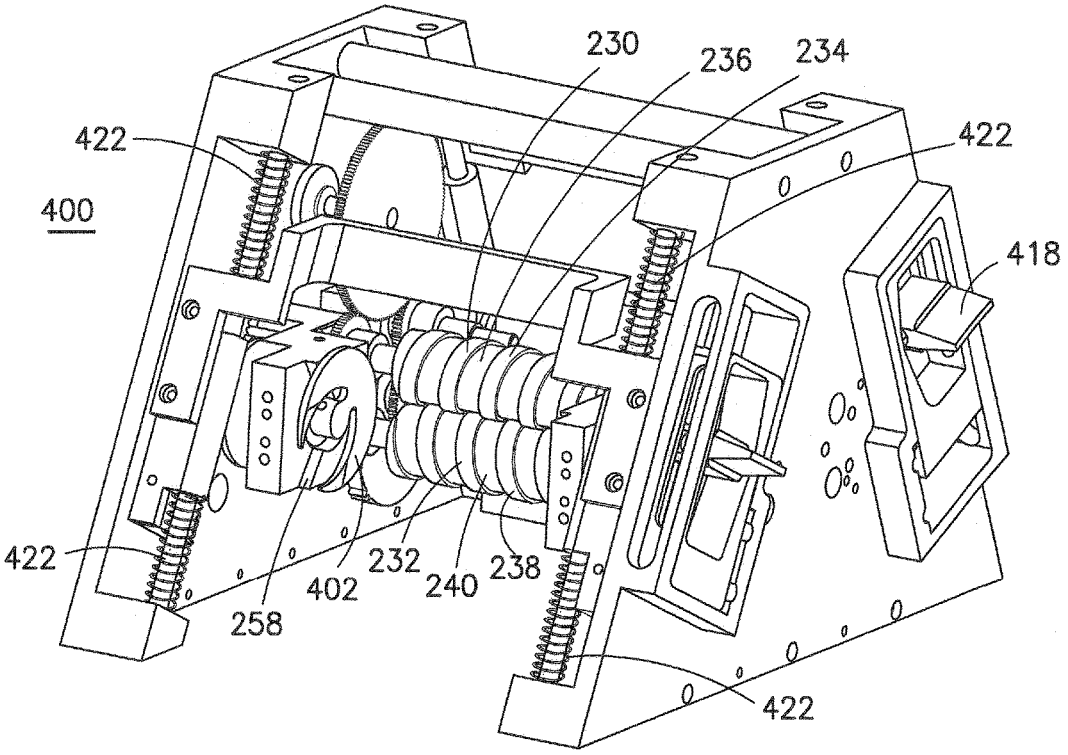
FIG. 35 is a perspective view of another embodiment of a razor treatment system according to the disclosure.

In an alternative embodiment, shown in FIGS. 18-20, the arcuate guide members 402 may be connected to a rack 412, received on linear bearing 414, and pinion 416 mechanism. In this embodiment, an actuating member 418, shown as a lever, uses linear motion to move the rack 412, which translates into rotation of the arcuate guide members 402. The user actuates the actuating member 418 that is connected to the rack 412, which turns the pinion 416, which is connected to the arcuate guide members 402. The limits of rotation of the arcuate guide members 402 are created by the linear distance the rack 412 is permitted to travel. Two hardstops 420 are positioned on the top and the bottom of the linear bearing 414 of the rack 412. In this embodiment, there are two different stable positions for the arcuate guide member 402. The first stable position occurs upon insertion of the razor 100A, 100B into the razor treatment device 200. The second stable position occurs when the blade 102 is engaged with the sharpening drums 230, 232, which is the position in which the actuating member 266 is rotated. Neither of these stable positions is at the hardstops 420 but rather in between the limits of travel of the rack 412. Full rotation of the arcuate guide members 402 (at the hardstop) only moves the blade 102 through the first two steps of movement (linear retraction and rotation), so to achieve the final linear extension of the blade 102, the arcuate guide member 402 needs to reverse direction to allow the blade springs 120 to extend the blade 102.

It is desirable to have a limited number of user inputs (or user actions) to operate the system. One action engages/disengages the blade 102 into the sharpening drums 230, 232 and one action rotates the sharpening drums 230, 232. By using the arcuate guide members 402 with offset stable positions, a complex motion with a single user input is achieved. The offset stable positions from the hardstops 420 are created by using springs 422 to bias the linear rack 412 to the middle of the stroke and spring plungers 426 (or similar "catches") that keep the rack 412 in place when it reaches the stable position.

It is contemplated that this razor treatment device 200 may be used on a horizontal surface or mounted vertically on wall, such as a wall in a shower. The razor treatment device 200 may be waterproof and may use water as a sharpening lubricant. The razor treatment device 200 may be cleaned with common household products (rubbing alcohol, vinegar, dish soap, etc.). The razor treatment device 200 may have a storage portion for the razor 100A, 100B to be housed in when not in use. The razor 100A, 100B may also have a separate blade protector that may be stored in the razor treatment device 200 or used to protect the blade 102 when not in use.

Turning now to one process for sharpening the blade 102 of the razor 100A, 100B, all movement will be described as viewed from the left side 206 of the housing 202. It is also to be understood that a similar process is used to strop the blade 102 of the razor 100A, 100B. First, the razor 100A, 100B is inserted into the razor treatment device 200. With the front of the razor head 108 facing the opening 218 on the front side 214 of the razor treatment device 200, a lever 116 on the back of the razor frame 104 is aligned in the hook 222 of the crossbar 220 above the opening 218. Once the lever 116 is engaged in the hook 222, the razor head 108 can be pivoted downward so that the cover 110 is aligned within the opening 218. The ball spring plungers 224 engage the lower edge 134 of the razor head 108 and lock it into place within the opening 218 as the razor head 108 is pivoted fully forward. When the razor head 108 is locked in place, the forked end 260 of each forked guide member 256 receives a respective blade pin 114.

With the razor head 108 in place, the user may initiate the process to sharpen the blade 102. In the resting position, the forked guide members 256 receive their respective blade pin 114 and the lower drum 232 is biased in a rearward position. As the user turns the lower actuating member 268 in a counterclockwise direction to initiate the honing process, the forked guide member 256 is likewise rotated in a counterclockwise direction around an axis perpendicular to the forked guide member 256. As this rotation occurs, the forked guide member 256 moves its associated blade pin 114. Each blade pin 114 moves along an associated cam track 258 surface. As the blade pin 114 moves along a first run 262 of the cam track 258, the blade pin 114 is moved toward the cover pin 130 of the razor head 108. The movement of the blade pins 114 toward the cover pin 130 compresses the springs 120 and the blade 102 is retracted from the pockets 132 of the cradles 124. As the forked guide member 256 pushes the blade pin 114 along a second run 264 of the cam track 258, the razor cover 110 is moved to an open position as it pivots around the cover pin 130. As a result of the spring-loading of the blade 102 within the cover 110 and the absence of the cradles 124 in its direct path, the blade 102 is then extended to a forward position as it moves into place against the upper sharpening drum 230.

During this movement of the forked guide member 256, counterclockwise rotation of the actuating member 268 causes the gear 244 also to rotate in a counterclockwise direction. As the teeth of the gear 244 engage the teeth of the gear 246, the gear 246 is rotated in a clockwise direction. A portion of the circumference of the gear 246 does not contain teeth. Consequently, as a toothless portion 247 of the gear 246 moves past the gear 248, there is no movement imparted to the gear 248. Once the forked guide member 256 reaches the end of its counterclockwise movement, the first tooth of the gear 246 engages the teeth of the gear 248 and the gear 248 is rotated in a counterclockwise direction. The counterclockwise rotation of the gear 248 is imparted to the linkage 250 and swings the linkage 250 in a forward direction (toward the razor 100A, 100B). The linkage 250 is attached to the lower sharpening drum 232, which is consequently swung into place against the upper sharpening drum 230 and the extended blade 102.

With the razor blade 102 and the sharpening drums 230, 232 in place, the user may turn the upper actuating member 266 to rotate the sharpening drums 230, 232 and sharpen the blade 102. The user may rotate the upper actuating member 266 in a counterclockwise direction, which results in the counterclockwise rotation of the upper sharpening drum 230. The drum gear 252 rotates counterclockwise with the upper sharpening drum 230 and imparts a clockwise rotation to the drum gear 254. The drum gear 254 is operatively connected to the lower sharpening drum 232, which consequently rotates in a clockwise direction. This coordinated rotation results in the sharpening of the blade 102 following a limited (for example, three or four) number of rotations of the actuating member 266, depending on the gear ratio used.

Once the sharpening process is complete, the lower actuating member 268 may be rotated in the opposite direction as previously described (clockwise, as viewed from the left side 206 of the housing 202) and the previous actions initiated with counterclockwise rotation of this actuating member 268 are reversed to retract the blade 102 and close the cover 110. Clockwise rotation of lower actuating member 268 results in the movement of the forked guide member 256 toward the front side 214 of the razor treatment device 200. As the forked guide member 256 moves forward, it pushes against the blade pin 114 and moves the blade pin 114 in the forward direction along the second run 264 of the cam track 258. The force against the blade pin 114 pushes the blade 102 back against the springs 120 and pulls the cover 110 into a closed position. When the forked guide member 256 moves the blade pin 114 along the reverse path of the first run 262 of the cam track 258, the blade pin 114 is released resulting in forward movement of the blade 102 within the cover 110. Since the cover 110 has been closed, the extension of the spring-loaded blade 102 is received into the pockets 123 of the cradles 124, locking the cover 110 closed and positioning the blade 102 for a close shave. The razor 100A, 100B may then be removed from the razor treatment device 200 by pulling on the handle 106 to release the razor head 108 from the ball spring plungers 108. The razor 100A, 100B may then be swung upward to release the lever 116 from the hook 222.

In an alternative embodiment, a different process uses the arcuate guide members 402 to sharpen the blade 102, wherein the razor 100A, 100B and blade 102 move through a similar motion. In an initial position, the actuating member 418 is in a first stable position. The actuating member 418 is linearly actuated in a downward position to the second stable position (where the blade 102 is retracted and fully rotated). The actuating member 418 is then released and pushed up into the first position by the springs 422. This allows the arcuate guide members 402 to rotate to allow the blade 102 to linearly extend in between the drums 230, 232. To release the razor 100A, 100B and blade 102 from the sharpening drums 230, 232, the actuating member 418 is pushed from the first stable position upward to a second stable position. This allows the blade pins 114 to move along the cam track 257, which allows the blade 102 to linearly retract into the cover 110, rotate about the handle 106, and linearly extend in the cover 110 to return the razor 100A, 100B to its normal operating condition.

As stated above, the blade 102 moves through a three phase motion to engage and disengage from the sharpening drums 230, 232. The cam track 257 provides the trajectory for this motion and the arcuate guide member 402 supplies the force to move the blade pins 114 along the track. However, the arcuate guide member 402 only moves the blade 102 through the first two stages. The third stage is achieved by the blade springs 120 extending the blade 102 along the remaining portion of the cam track 257. An additional "catch" may be needed to keep the blade in position when it transitions from phase 2 (rotation) to phase 3 (linear extension). Without the "catch", the blade 102 may rotate in the opposite direction rather than extend linearly. Therefore, the magnets 118 may be used to keep the blade 102 in a linearly extending motion, rather than rotating in an opposite direction. The magnets 118 interact with cross member 424 to keep the blade 102 in the correct position. In the reverse motion (disengaging the blade 102 from the sharpening drums 230, 232), the same motion is achieved, but in the opposite direction. The magnets 118 also help to keep the cover 110 closed in the shaving position as well.

The foregoing embodiments are not to be construed as limiting of the present invention but are illustrative thereof. Although exemplary embodiments of this invention have been described, it will be clear to those skilled in the art that many modifications in the exemplary embodiments are possible without materially departing from the novel teachings and advantages of this invention. For example, the locations of the actuating members 266, 268, 312, 314, 418 and/or the location of the opening 218 on the device 200 can be varied, provided that their relationship and interaction with the associated components of the device that are critical for the function of the device are properly maintained. Also, different mechanisms may be used to move the pins 114 so as to retract the blade 102 to expose the blade 102 for sharpening; similarly, other mechanisms may be used to retract the blade 102. Other variations and modifications will be understood by one of skill in the art. Accordingly, all such modifications are intended to be included within the scope of this invention.

While an embodiment of a razor and treatment system is shown in the accompanying figures and described hereinabove in detail, other embodiments will be apparent to, and readily made by, those skilled in the art without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A razor treatment system, comprising:

a razor having a head, wherein the head includes a cover for housing a blade, wherein the cover is configured to expose the blade; and a razor treatment device including a drum rotationally supported within the razor treatment device, wherein the razor interfaces with the razor treatment device to move the cover of the razor to expose the blade for treatment of the blade by the drum.

2. The razor treatment system as claimed in claim 1, wherein the razor treatment system further comprises a sharpener comprising at least two cam members supported within the razor treatment device, at least two guide members configured to cooperate with the cam members to expose the blade, and a first actuating member configured to effect rotation of the guide members.

3. The razor treatment system as claimed in claim 2, wherein each cam member defines a cam track that guides linear retraction of the blade, rotational movement of the blade and cover, and linear extension of the blade into a position on the drum.

4. The razor treatment system as claimed in claim 1, wherein the blade of the razor is spring-biased in the cover.

5. The razor treatment system as claimed in claim 4, wherein the razor further comprises at least one cradle member positioned on the head of the razor and configured to hold the spring-biased blade within the cover of the razor, wherein the blade is spring-biased against the cradle member and contacts the cradle member at a portion that is abraded to position a cutting edge of the blade in a same position after each use of the razor treatment system.

6. The razor treatment system as claimed in claim 2, wherein at least a portion of a surface of the drum comprises an abrasive material.

7. The razor treatment system as claimed in claim 6, further comprising a second drum having at least a portion of a surface thereof comprising an abrasive material.

8. The razor treatment system as claimed in claim 6, wherein the abrasive material is provided in a spiral configuration around the outer surface of the drum.

9. The razor treatment system as claimed in claim 3, wherein the razor further includes a pair of pins, each pin extending from an end of a longitudinal axis of the blade and extending out of the cover of the razor, and wherein the pins are movable along the cam track of each cam member by each guide member in order to expose the blade in the razor treatment device.

10. The razor treatment system as claimed in claim 9, wherein each guide member is arcuate-shaped and defines at least two recesses with surfaces configured to guide the pins along the cam track of each cam member.

11. The razor treatment system as claimed in claim 1, wherein the razor further comprises at least one latching mechanism positioned on at least one of a top surface of the cover and a bottom surface of the cover.

12. The razor treatment system as claimed in claim 2, wherein the razor treatment device further includes a stropping portion.

13. The razor treatment system as claimed in claim 12, wherein the stropping portion comprises another rotatably mounted drum comprising on a surface thereof a material suitable to strop the blade.

14. A shaving razor, comprising:

a handle; and a head comprising a blade and a cover, the head pivotally connected to the handle, and the cover housing the blade and pivotally connected to the head; and wherein the cover is rotatable relative to the handle so that the blade is movable relative to the cover to extend from the cover to extend a shaving edge of the blade from the cover.

15. The shaving razor as claimed in claim 14, wherein the blade is spring-biased within the cover.

16. The shaving razor as claimed in claim 15, the razor further comprising a pair of pins, wherein each pin extends out of the cover of the razor along a longitudinal axis of the blade.

17. The shaving razor as claimed in claim 15, the razor further comprising at least one cradle member positioned on the head of the razor and configured to hold the spring-biased blade within the cover of the razor, wherein the blade is spring-biased against the cradle member and contacts the cradle member at a portion that is abraded to position a cutting edge of the blade in a same position after each use of the shaving razor.

18. A razor treatment device, comprising:

a drum rotationally supported within a housing, at least two cam members supported within the housing, at least two guide members configured to interact with the cam members to rotate a cover of a shaving razor, and a first actuating member configured to effect rotation of the guide members.

19. The razor treatment device as claimed in claim 18, further comprising a second drum rotationally supported within the housing.

20. The razor treatment device as claimed in claim 19, wherein each cam member defines a cam track that guides linear retraction of a blade of a shaving razor, rotational movement of the blade and a cover of the shaving razor, and linear extension of the blade into a position between the drums.

21. The razor treatment device as claimed in claim 20, wherein at least a portion of at least one drum comprises an abrasive material.

22. The razor treatment device as claimed in claim 21, wherein the abrasive material is provided in a spiral configuration around the outer surface of the drums.

23. The razor treatment device as claimed in claim 20, wherein each guide member is arcuate-shaped and defines at least two recesses with surfaces configured to guide the blade of the shaving razor along the cam track of each cam member.

24. The razor treatment device as claimed in claim 21, further comprising a stropping portion rotatably supported within the housing.

25. The razor treatment device as claimed in claim 24 wherein the drum and the second drum are rotatably positioned on one side of the razor treatment device and the stropping portion is rotatably positioned on an opposite side of the housing.

26. The razor treatment device as claimed in claim 25, wherein the stropping portion comprises a rotatably supported drum comprising a surface bearing a material suitable to strop the blade.

* * * * *